US005921863A

United States Patent [19]

Sells

[11] Patent Number: 5,921,863

[45] Date of Patent: Jul. 13, 1999

[54] ROOF VENTILATING DEVICE

[75] Inventor: Gary L. Sells, Mishawaka, Ind.

[73] Assignee: Cor-A-Vent Incorporated, Mishawaka, Ind.

[21] Appl. No.: 08/269,916

[22] Filed: Jun. 30, 1994

[51] Int. Cl.[6] ..... F24F 7/02

[52] U.S. Cl. ..... 454/359; 454/365

[58] Field of Search ..... 454/358, 359, 454/360, 361, 363, 364, 365

[56] References Cited

U.S. PATENT DOCUMENTS

| | | | |
|---|---|---|---|
| 1,897,440 | 2/1933 | Richardson | 454/359 X |
| 3,403,616 | 10/1968 | Nelson | 454/359 X |
| 4,899,647 | 2/1990 | Garries et al. | 454/359 X |
| 5,080,005 | 1/1992 | Kolt | 454/359 |
| 5,092,225 | 3/1992 | Sells | 454/365 |

FOREIGN PATENT DOCUMENTS

| | | | |
|---|---|---|---|
| 33523 | 3/1980 | Japan | 454/365 |

*Primary Examiner*—Harold Joyce
*Attorney, Agent, or Firm*—Baker & Daniels

[57] ABSTRACT

A ventilating device for a roof having a vent opening includes a cover for a vent opening in the roof. The cover defines vent passages for communicating the vent opening to ambient atmosphere. A moveable member mounted adjacent to the passages is moveable from an open or inactive position permitting communication through the passages to an active or closed position in which the moveable member closes the passage to restrain entry of wind driven rain and or snow into the passages. The moveable members are returned to their inactive or open position by the resiliency of the material from which the moveable members are made and/or by the force of gravity.

26 Claims, 19 Drawing Sheets

ROOF VENTILATING DEVICE

This invention relates to a roof ventilating device which is provided with a movable member or baffle that prevents wind driven snow or rain from entering the ventilating device.

Roof ventilators have been used to prevent dangerous heat build-up in the attics or upper floors of houses and other structures. One such roof ventilator is disclosed in U.S. Pat. No. 3,949,657. The roof ventilator disclosed in this patent provides a cover for an elongated opening cut along the ridge of a roof. The ventilating device covers the opening, and provides relatively narrow passages to vent heat from the interior of the structure. The passages are designed to be small enough so that entry of moisture is restricted. However, during storms, wind driven rain or snow can be forced into the roof opening through the passages if the wind is strong enough. Accordingly, it is desirable to restrict entry of snow and rain into the ventilating device even under such adverse storm conditions.

The present invention provides a movable member or baffle having a pressure responsive surface that responds to the pressure generated by wind speeds in excess of a predetermined level to move into a position closing the passages and thus preventing entry of wind-driven rain and snow into the ventilating device. Accordingly, the present invention has the advantage of preventing wind-driven moisture such as rain and snow from being forced into the attic or upper floor of a house or other structure through openings cut in the roof for ventilation. Another advantage of the present invention is that a flexible member or baffle responds to high winds to close off the ventilating device, but is normally disposed away from the vent passages which provide ventilation to freely vent warm air through a vent opening and from the interior passages of the structure. Still another advantage of the present invention is that the movable member or baffle which closes off the passage is restored to its inactive position in which venting through the ventilating device is permitted by the resiliency of the baffle or member and/or the force of gravity.

These and other advantages of the present invention will become apparent from the following description, with reference to the accompanying drawings, in which.

Figure 1:
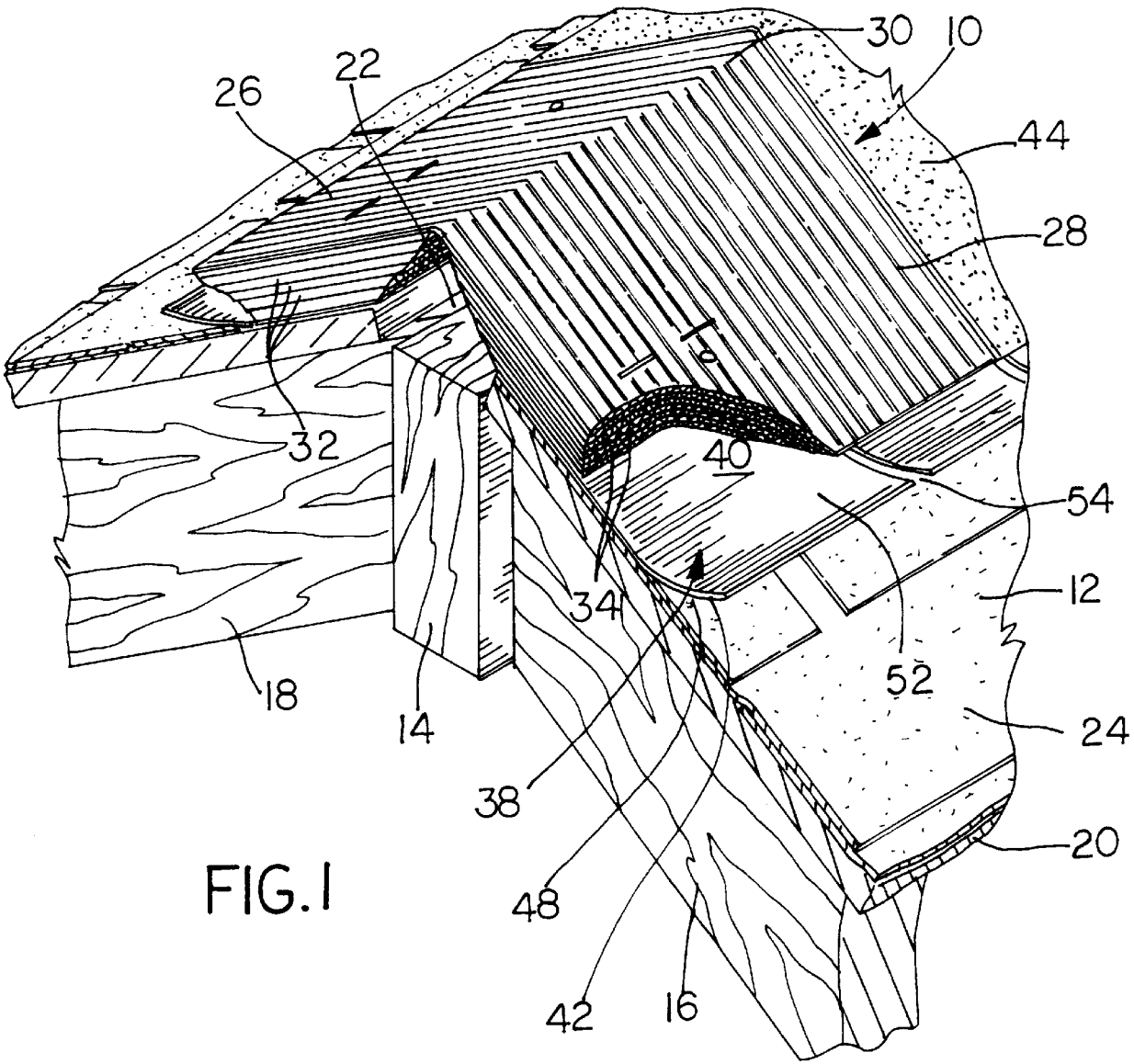
FIG. 1 is a fragmentary perspective view, partly in section, of a ventilating device made pursuant to the present invention applied over a vent opening in a roof.
Figure 2:
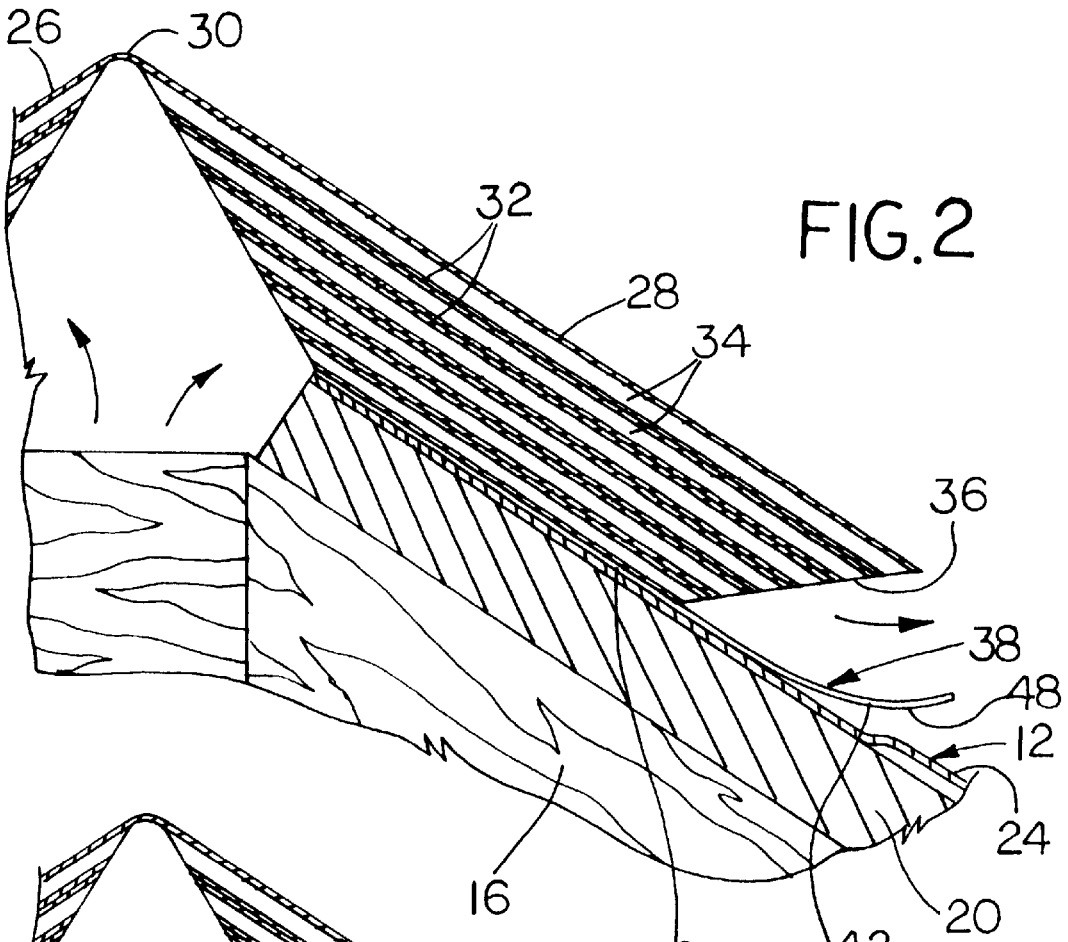
FIG. 2 is a fragmentary cross-sectional view taken through the ventilating device in the roof illustrated in FIG. 1, which illustrates the movable member or flexible baffle of the present invention in the open or inactive position in which venting through the ventilating device is permitted.
Figure 3:
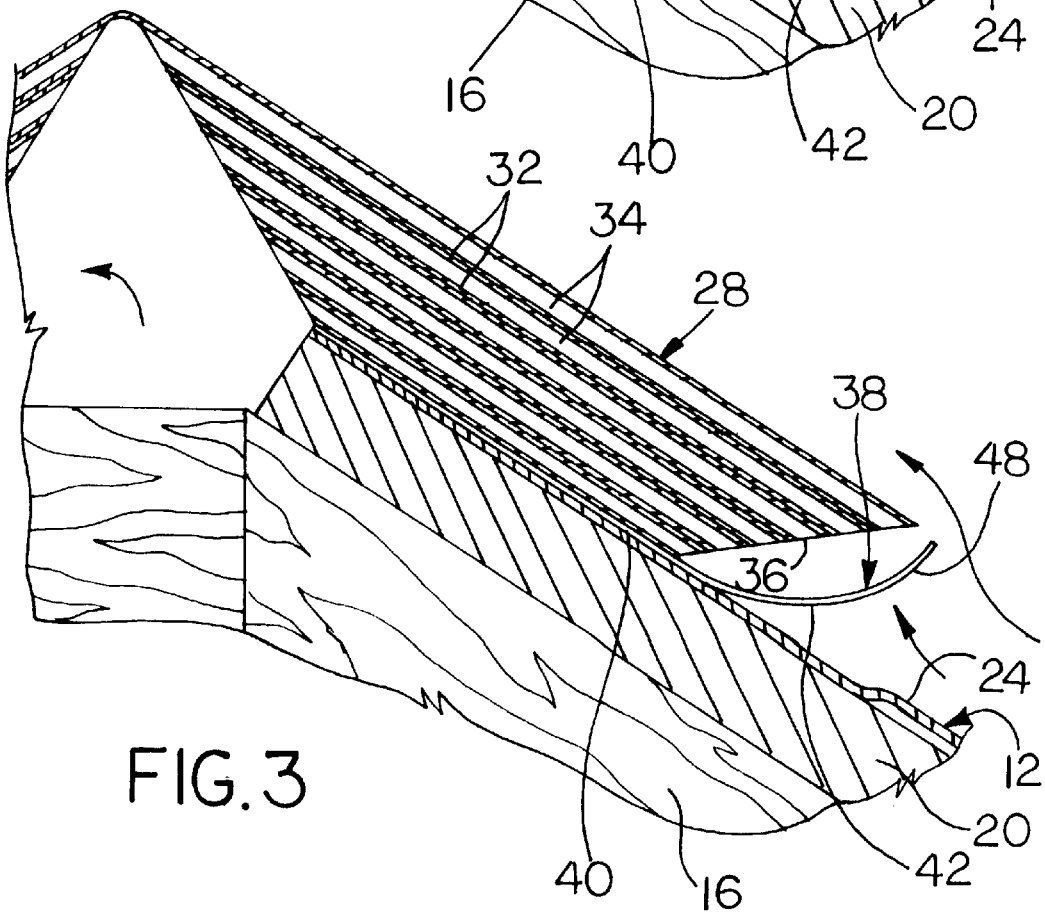
FIG. 3 is a view similar to FIG. 2, but illustrating the movable member or flexible baffle according to the present invention in the closed or active position in which wind driven rain and snow is prevented from entering the ventilating device.
Figure 11:
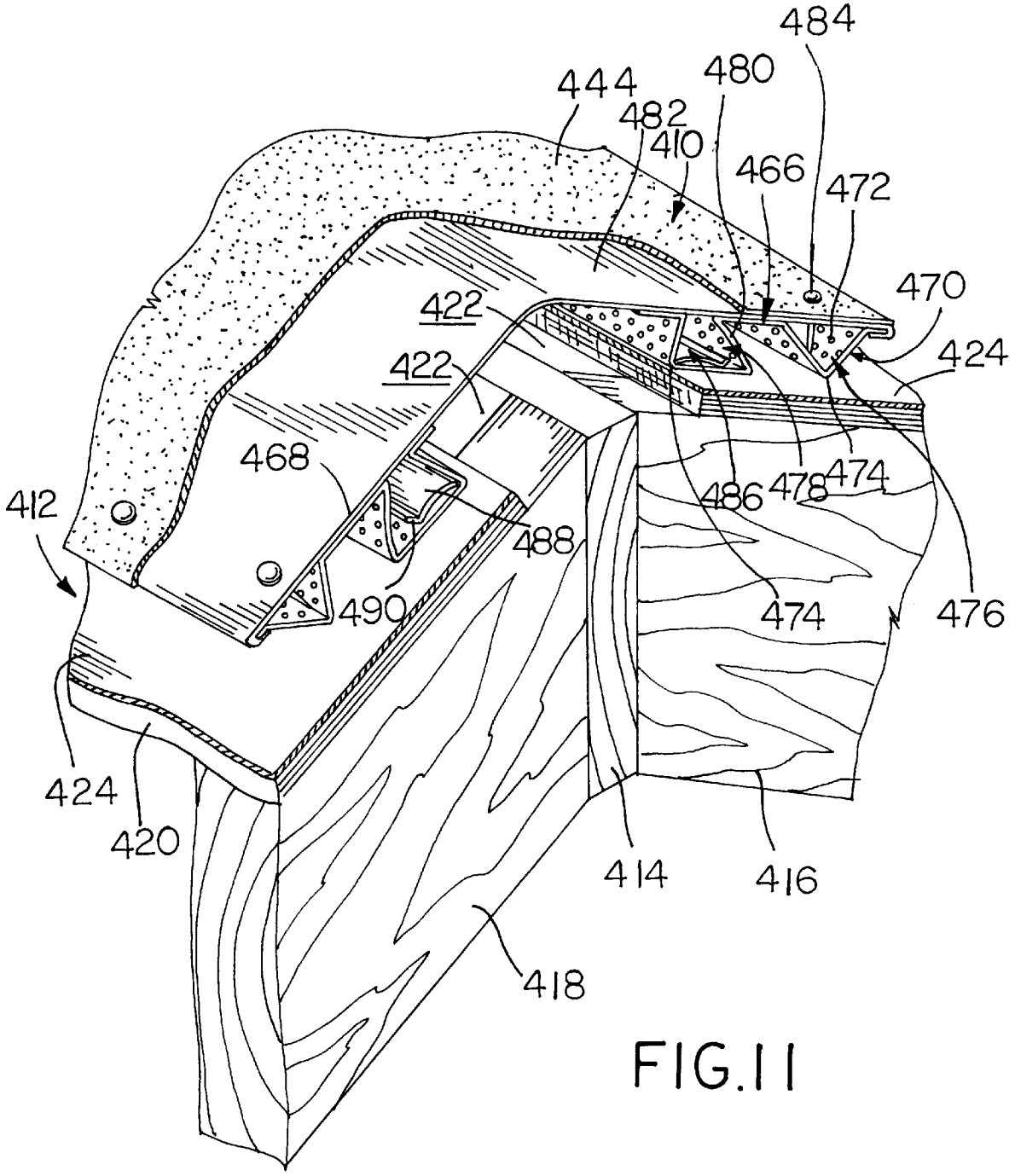
Figure 12:
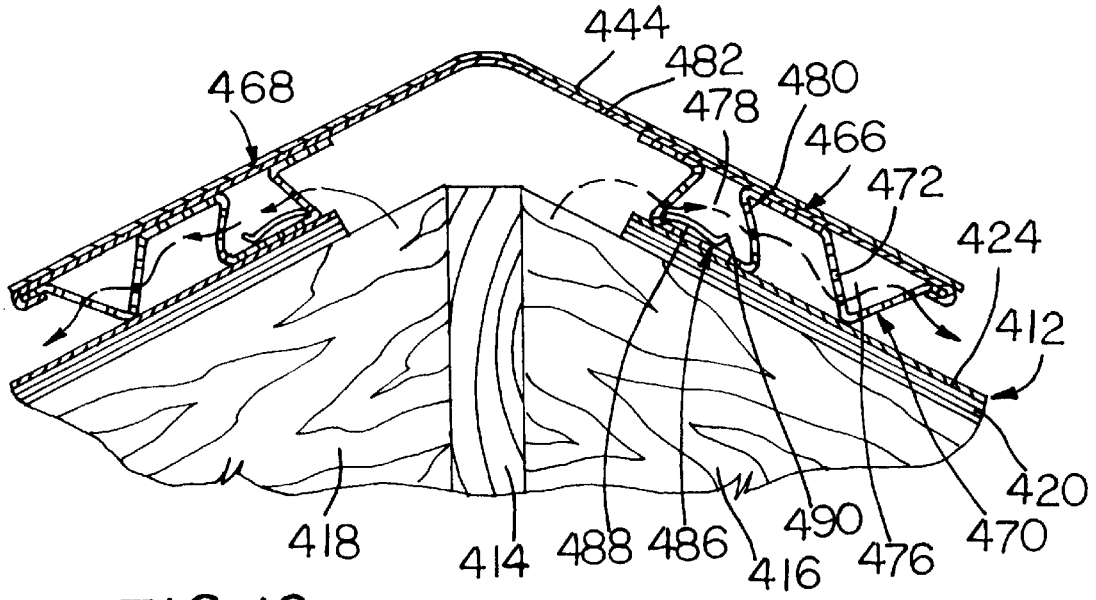
Figure 13:
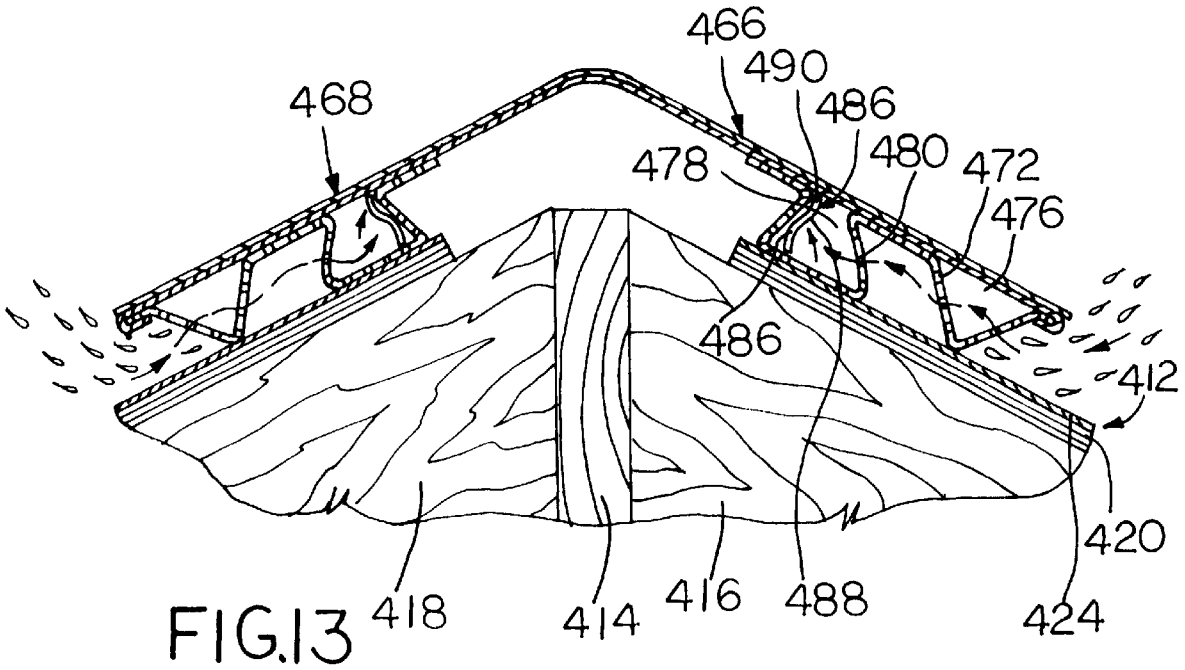
Figure 14:
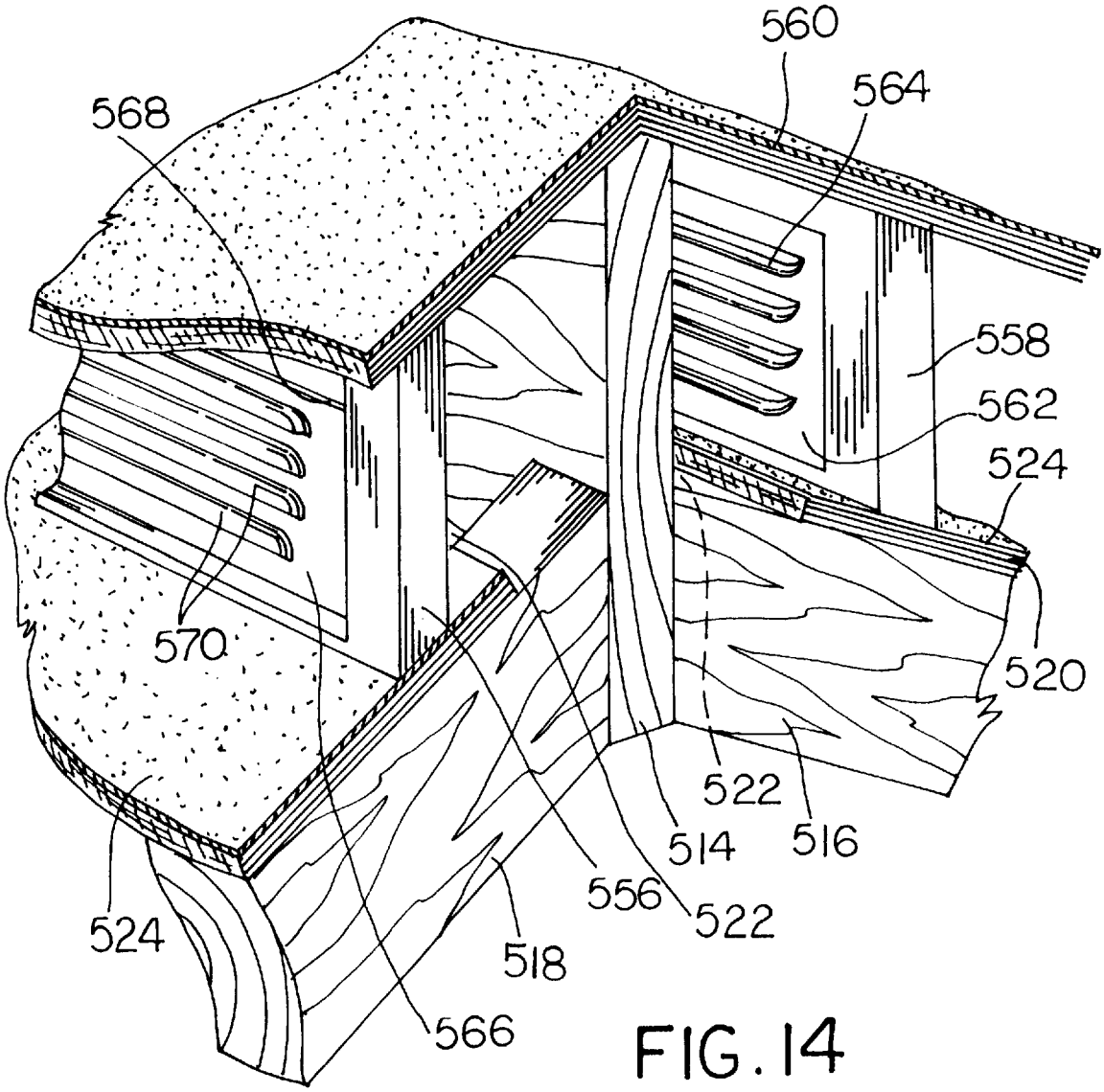
Figure 15:
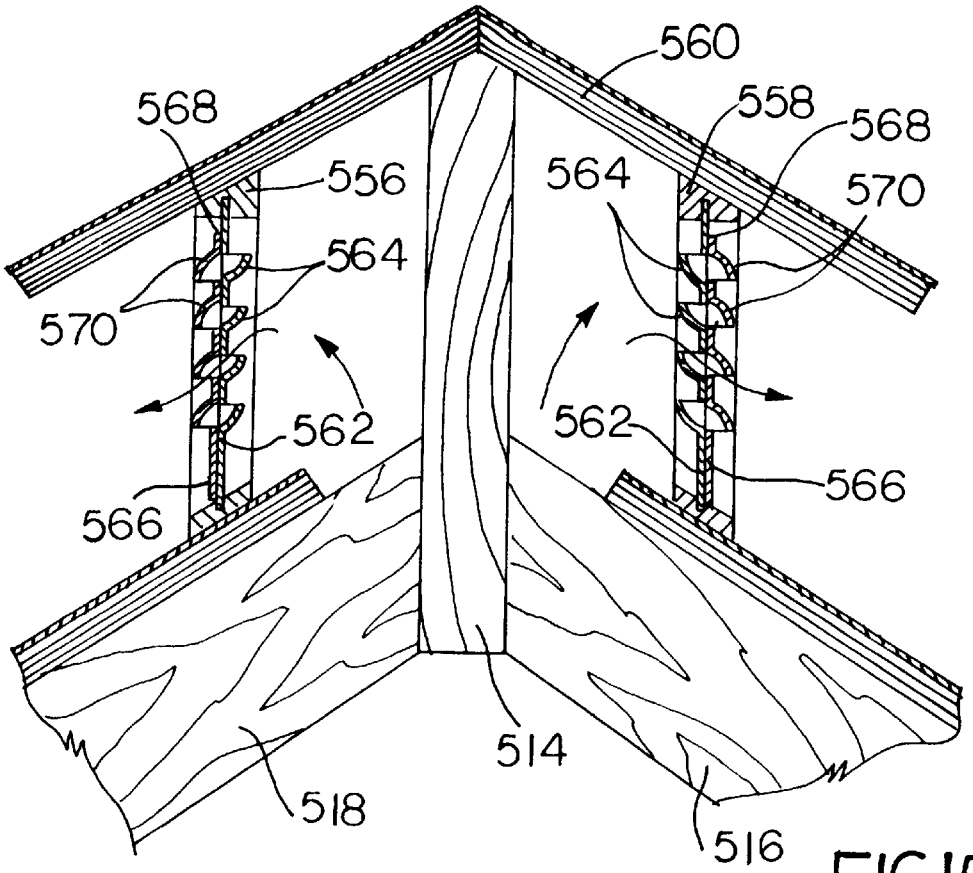
Figure 16:
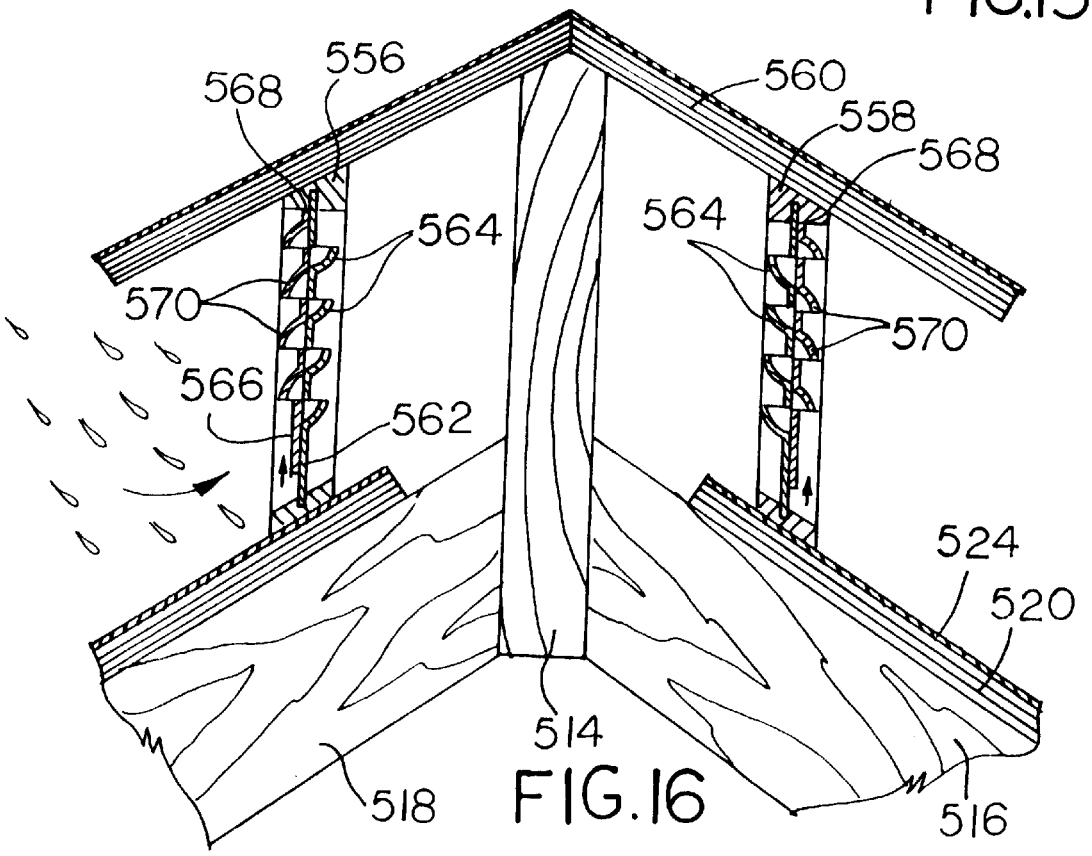
Figure 17:
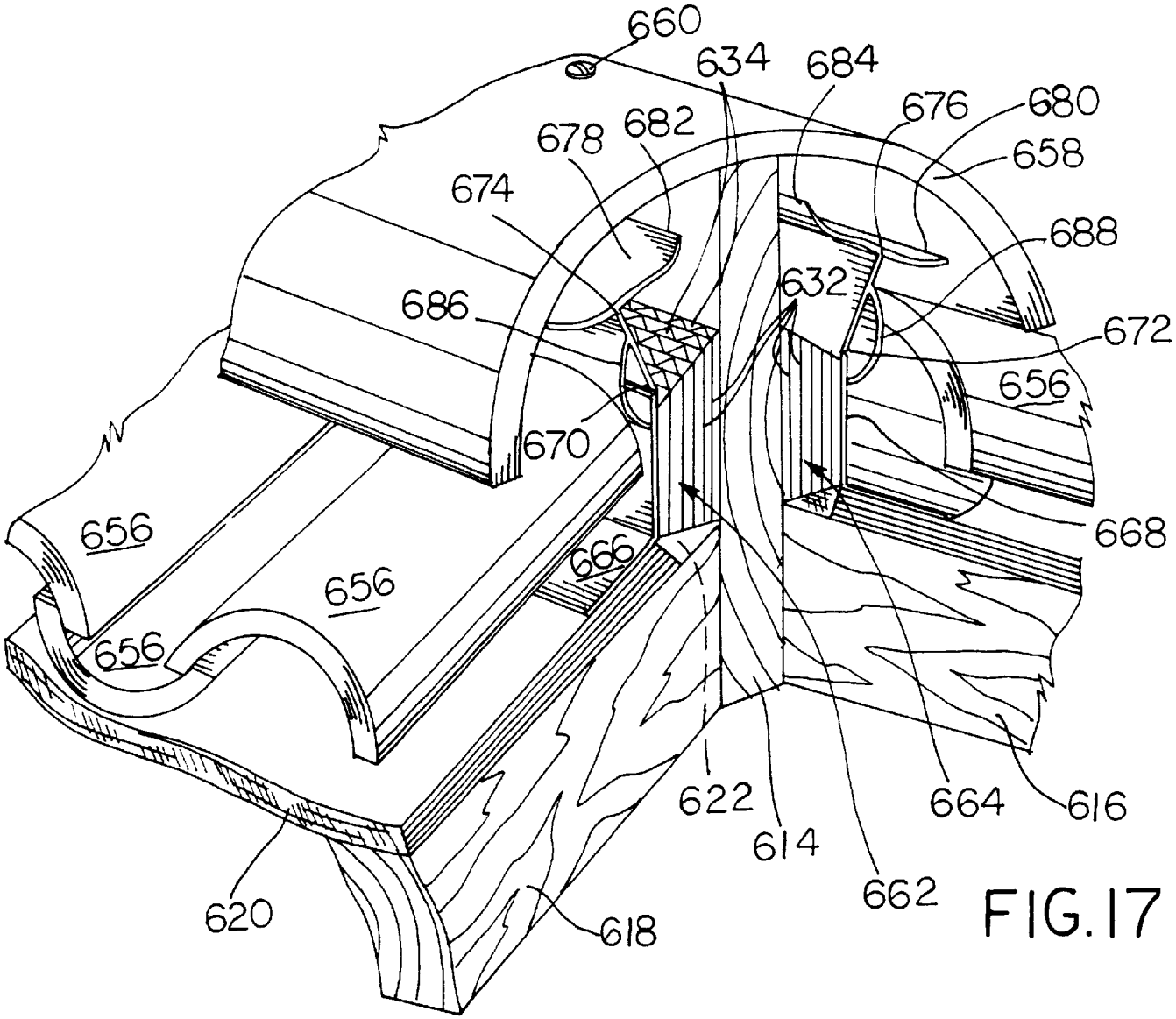
Figure 18:
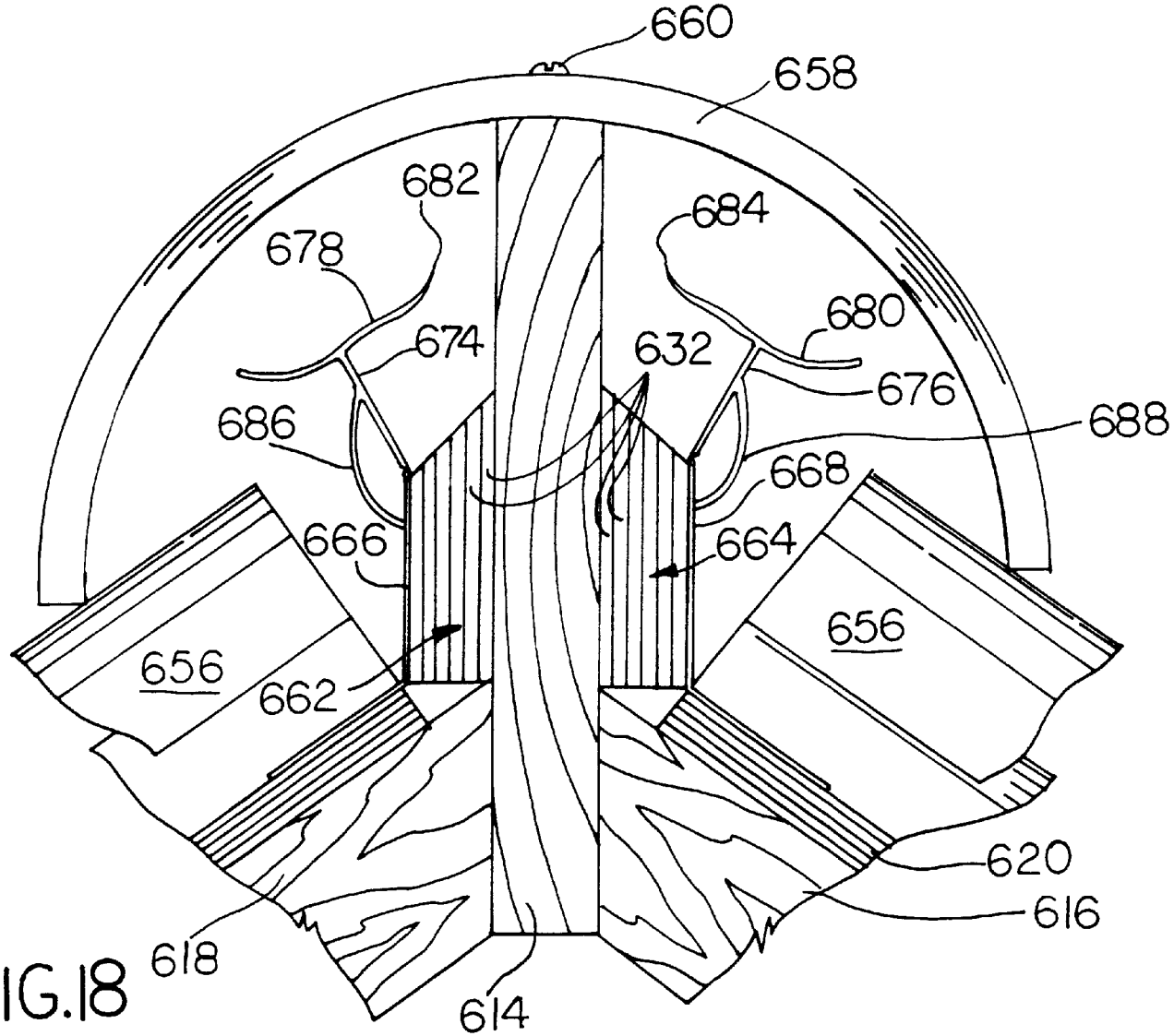
Figure 19:
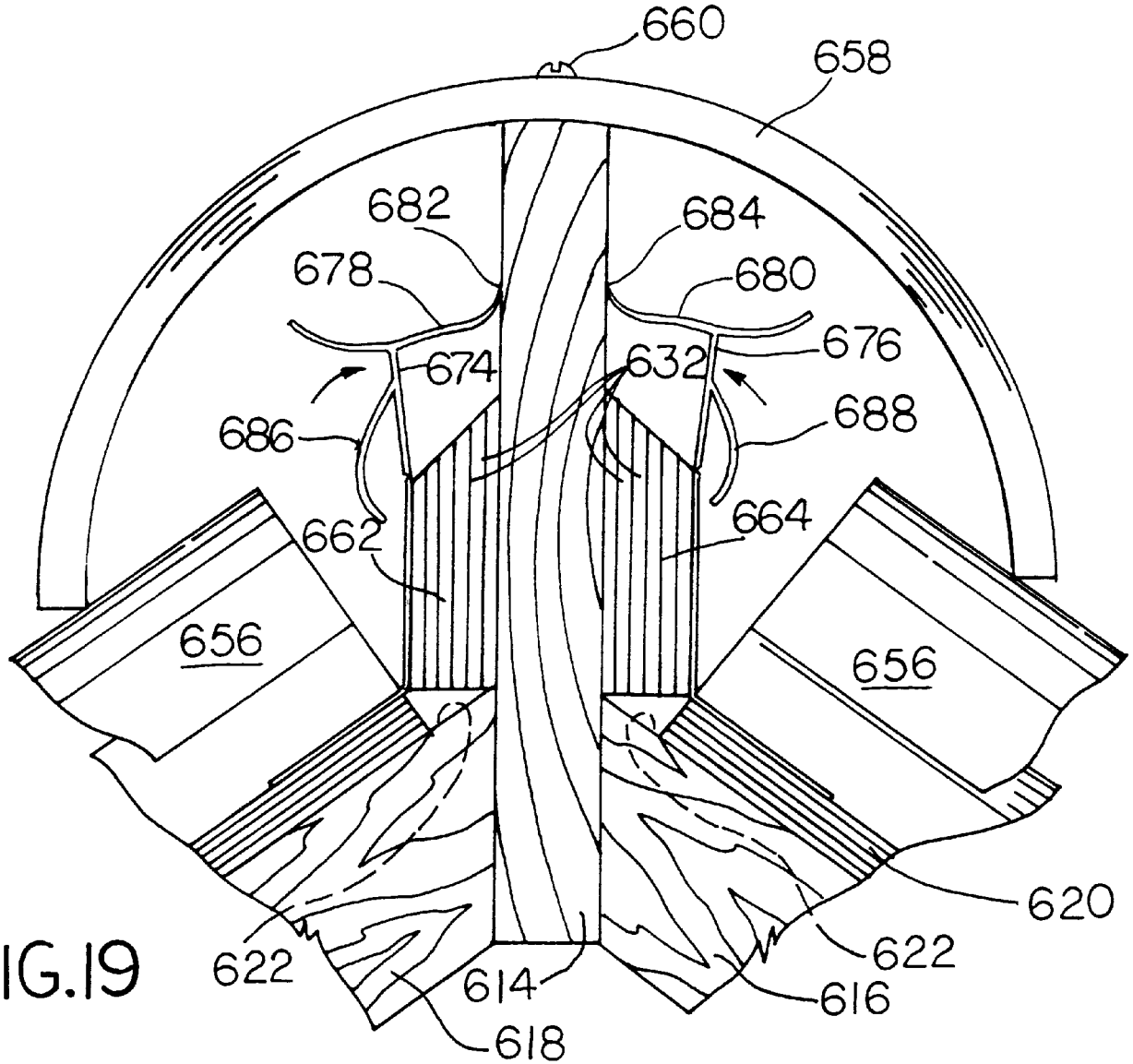
Figure 20:
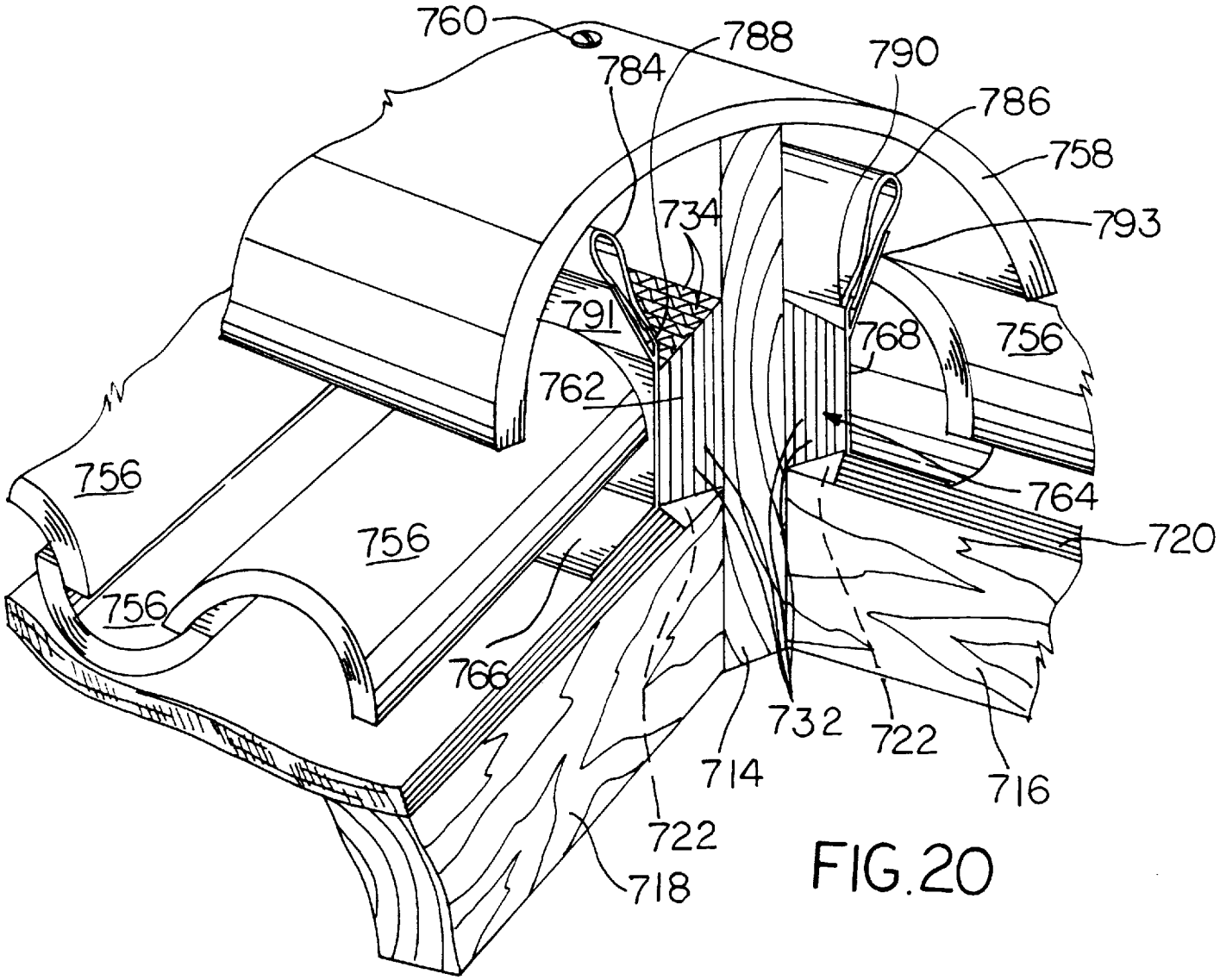
Figure 21:
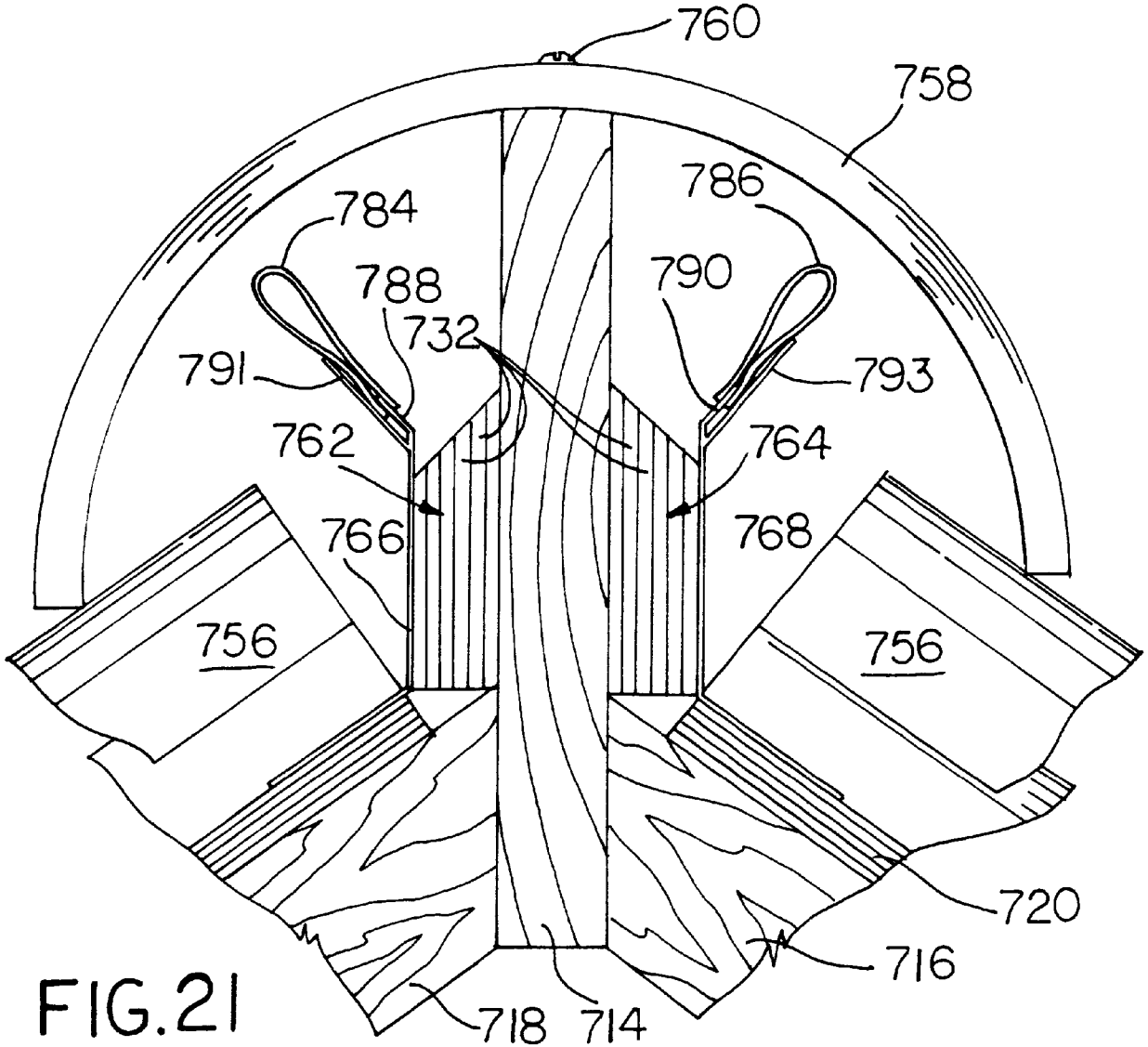
Figure 22:
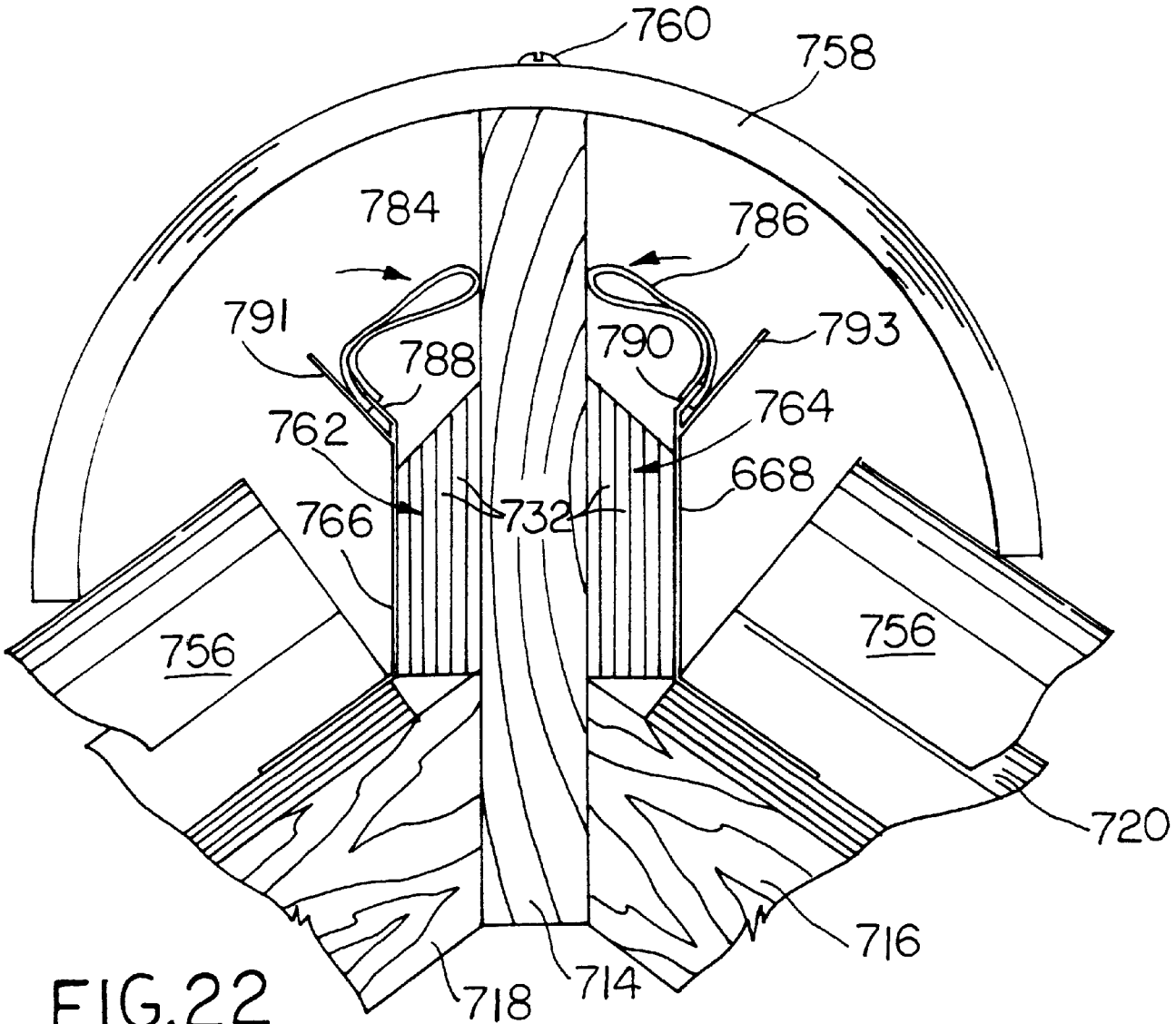
Figure 23:
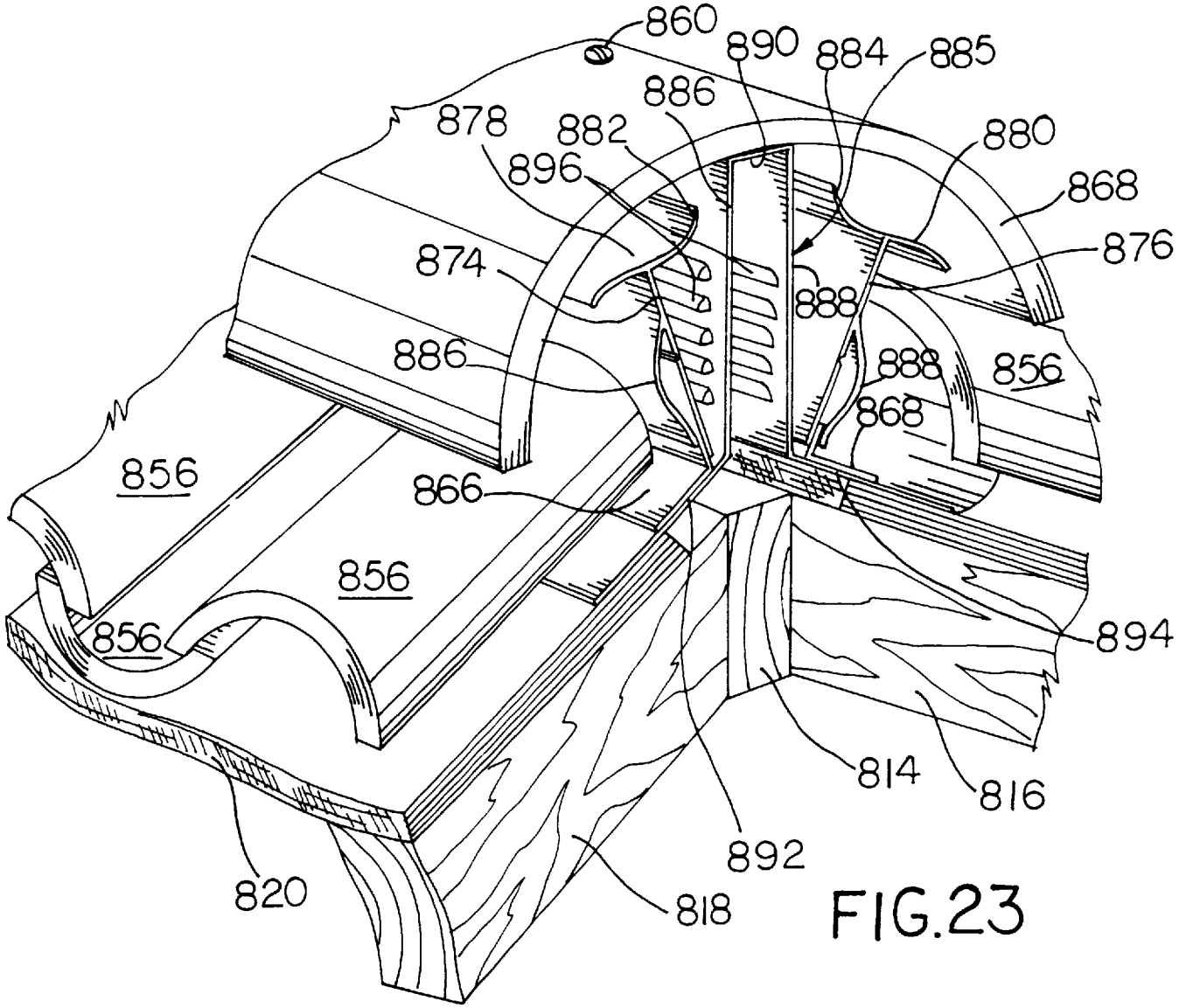
Figure 24:
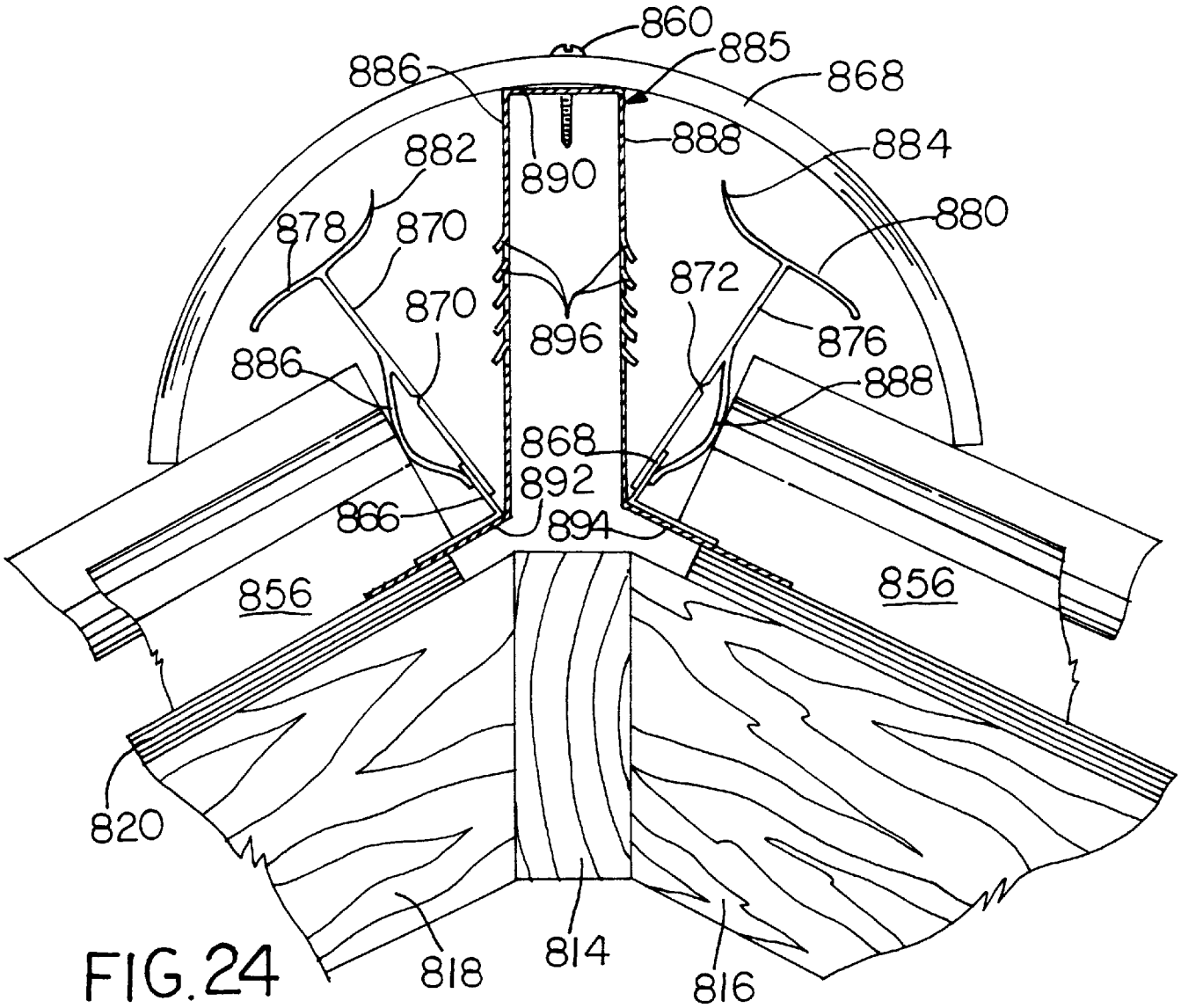
Figure 25:
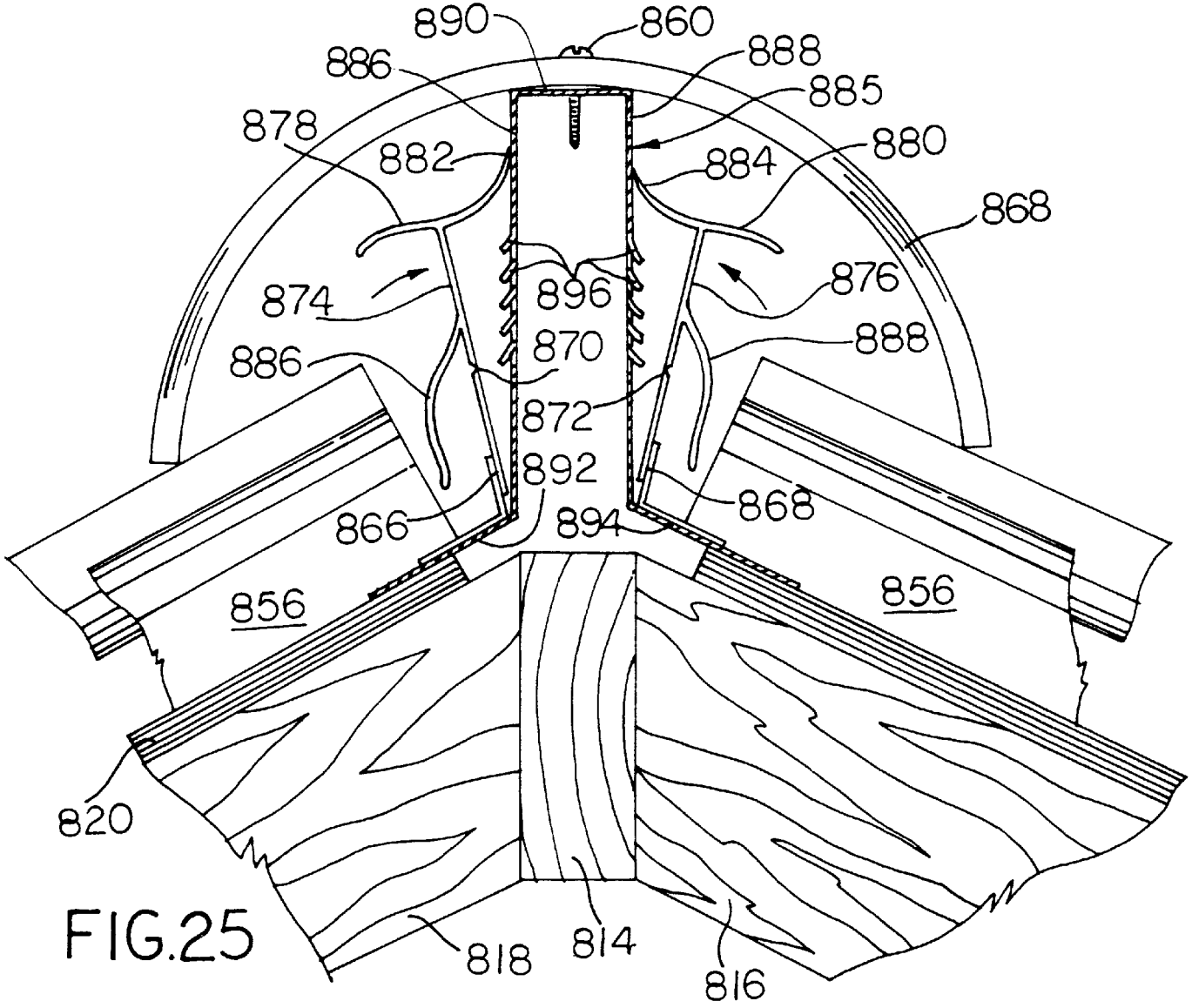

FIG. 11, FIG. 12, and FIG. 13 are views similar to FIG. 1, FIG. 2, and FIG. 3 respectively, but illustrating still another embodiment of the present invention;

FIG. 14, FIG. 15, and FIG. 16 are views similar to FIG. 1, FIG. 2, and FIG. 3 respectively, but illustrating still another embodiment of the present invention;

FIG. 17 is a fragmentary perspective view, partly in section, of a tile roof and illustrates an embodiment of the invention as applied to such tile roofs;

FIG. 18 is a cross sectional view of the embodiment of the invention illustrated in FIG. 17 and illustrates the moveable member of the invention in the inactive or open position;

FIG. 19 is a cross sectional view similar to FIG. 18, but illustrates the moveable member of the invention in the active or closed position;

FIG. 20, FIG. 21, and FIG. 22 are views similar to FIG. 17, FIG. 18, and FIG. 19 respectively, but illustrating still another embodiment of the invention;

FIG. 23, FIG. 24, and FIG. 25 are views similar to FIG. 17, FIG. 18, and FIG. 19 respectively, but illustrating a still further object of the invention.

Referring now to FIGS. 1–3, a roof ventilating device generally indicated by the numeral 10 according to the present invention is applied to the ridge of a roof generally indicated by the numeral 12. Roof 12 includes a longitudinally extending ridge member 14 and transversely spaced inclined rafters 16, 18. The rafters 16,18 are covered by underlayment or sheathing generally indicated by the numeral 20. A portion of the sheathing 20 adjacent the ridge member 14 is cut away to define a vent opening 22 which extends longitudinally along both sides of the ridge member 14. Shingles 24 are applied to the sheathing or underlayment 20 to complete the roof.

The ventilating device 10 includes a pair of vent parts 26, 28 which are joined at apex 30. Vent parts 26, 28 are applied to the sheathing 20 on opposite sides of the ridge member 14 respectively and thus completely cover the vent opening 22. As more clearly described in the aforementioned U.S. Pat. No. 3,949,657, the vent parts 26, 28 each include several courses or plies of a corrugated material which has been waterproofed by treatment by a appropriate material such as by epoxy paint. Accordingly, each of the courses or plies 32 define a series of substantially parallel passages 34 which communicate the vent opening 22 to the ambient atmosphere. The ends of the passages 34 define longitudinally extending edge 36 of the vent parts 26, 28.

According to the invention, a deflectable member or baffle generally indicated by the numeral 38 is made of a pliable plastic or other resilient roofing material and includes a retaining portion 40 which is disposed between the corresponding vent part 26 or 28 and the shingles 24 applied to underlayment or sheathing 20. Baffle 38 includes a closing portion 42 which extends from the retaining portion 40 and curves upwardly away from shingles 24 as illustrated in FIG. 2. Shingles 44 are applied over the vent parts 26, 28. The shingles 24, the vent parts 26,28, and the retaining portion 40 of baffle 38 are all secured to the underlayment 20 by fasteners. For example roofing nails 46, which are driven through the shingles 44, the corresponding vent part 26 and 28, and the retaining portion 40 of baffle 38, secure all of them to the roof. Baffle 38 extends longitudinally for substantially the entire length of the roof in which the opening 22 has been cut, and separate baffle 38 are provided for each of the vent parts 26,28. The closing portion 42 of each baffle 38 includes a pressure responsive surface 48 which is exposed to atmospheric wind pressure, as will hereinafter be explained. The closing portion 42 of each baffle 38 is divided into relatively moveable sections 52 by transversely extending slits 54. Slits 54 permits moisture to drain off of the baffle 38. The fact that the baffle is divided into sections reduces the wind speed necessary to cause sufficient pressure on pressure responsive 48 to activate the baffle. As illustrated in FIG. 3, when the pressure of ambient wind acting on pressure responsive surface 48 is sufficient to overcome the resiliency of the baffle, the baffle is moved to the active or closed position illustrated in FIG. 3 from the inactive or open position illustrated in FIGS. 1 and 2. As illustrated in FIG. 3, when the baffle 38 is in the active or closed position, wind driven moisture is restrained from entering the ends 36 of the passages 34. By dividing the baffle 38 into the sections 52, some of the sections 52 may be moved to the active or closed positions while other sections, even on the same side of the structure, remain in the open or inactive position. Accordingly, venting can still occur through the portions of the vent parts 26, 28 in which the sections 52 of baffle 38 remain in the open or inactive position. Furthermore, since ambient wind pressure blowing against the baffle 38 on one side of the structure will move that baffle to the active or closed position, the baffle on the other side of the structure may remain in the inactive or open position.

Figure 4:
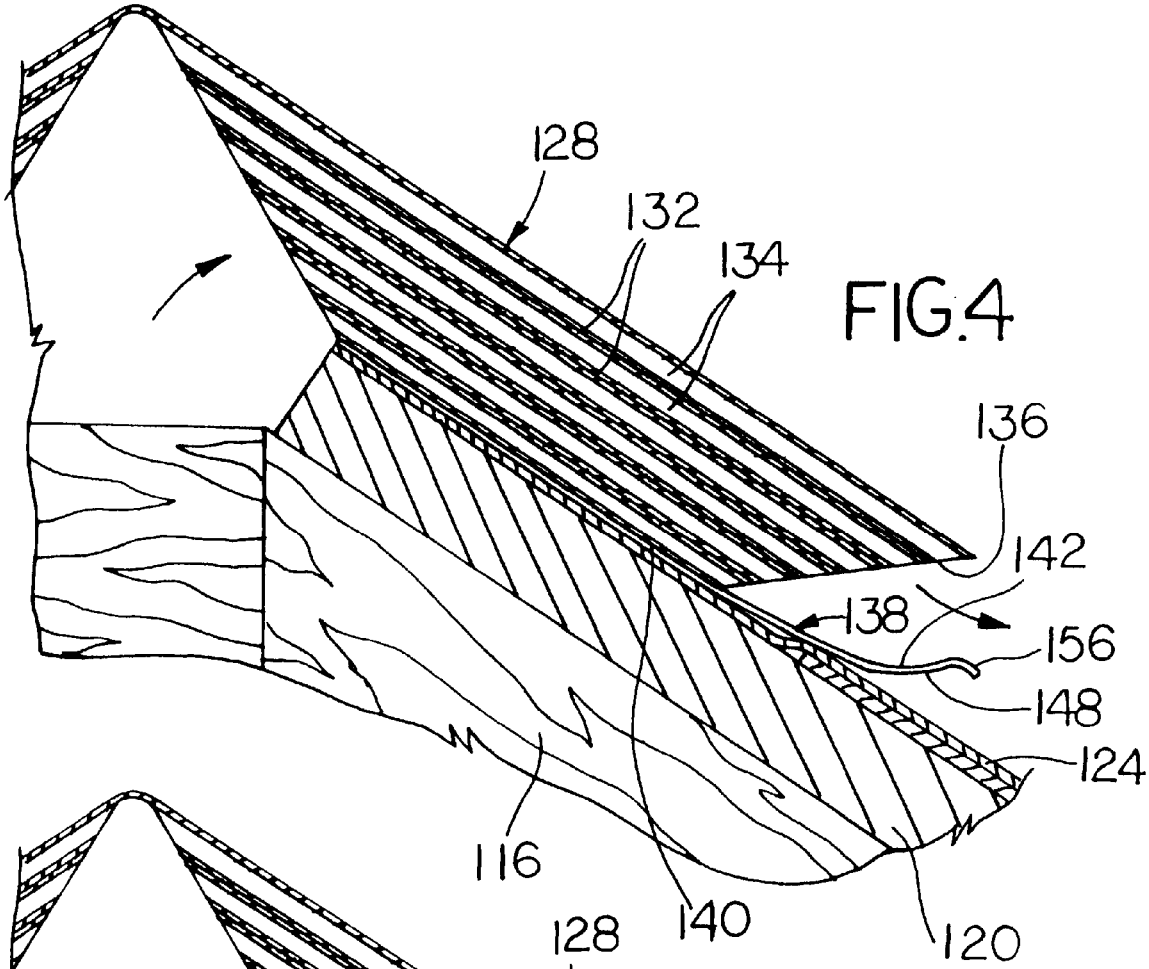
FIGS. 4 and 5 are views similar to FIGS. 2 and 3 respectively, but illustrating another embodiment of the present invention in which a projecting lip is provided.
Figure 5:
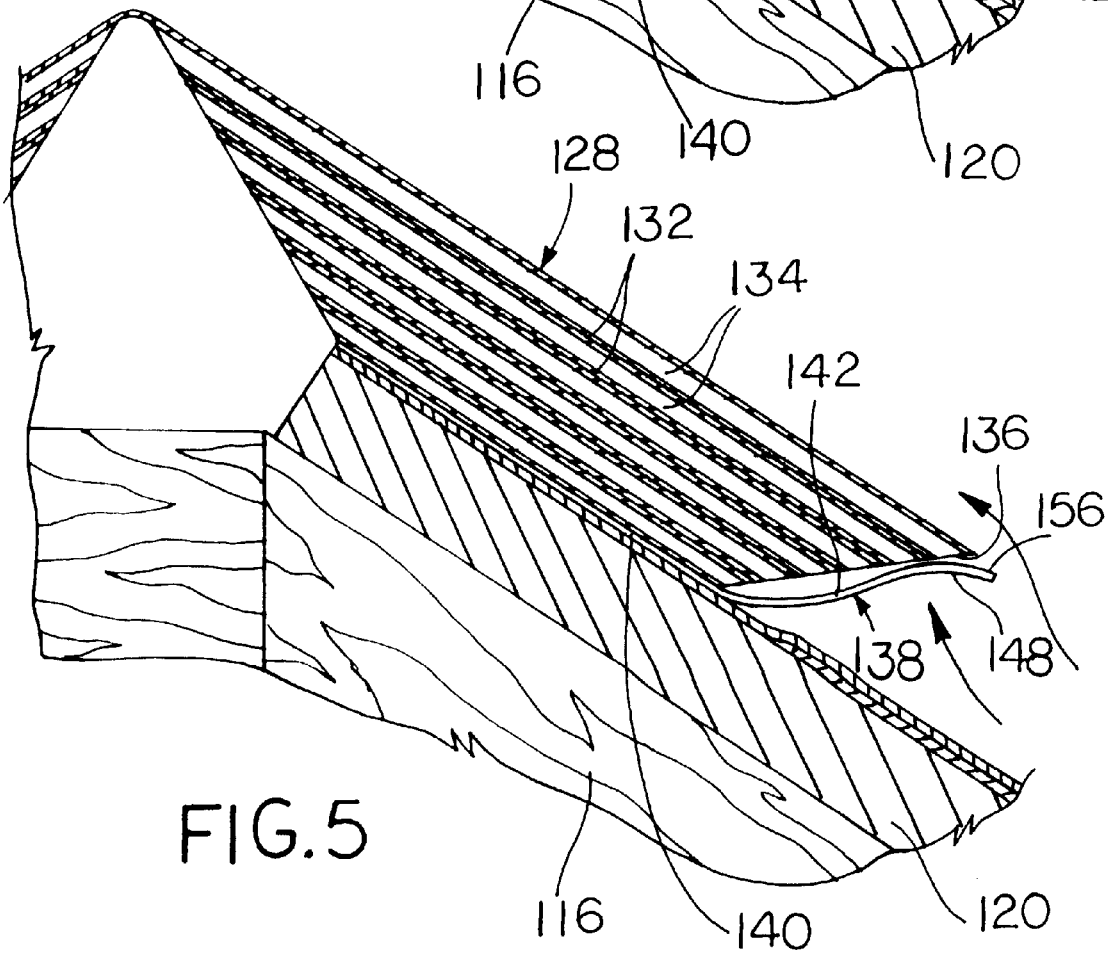

Referring now to the embodiment of FIGS. 4 and 5, elements the same or substantially the same as those in the embodiment of FIGS. 1–3 retain the same reference numeral, but increased by 100. The baffle 138 of the embodiment of FIGS. 4 and 5 is substantially the same as the baffle 38 in the embodiment of FIGS. 1–3, except that an outwardly directed lip 156 projects from the closing portion 142 of the baffle 138. The lip 156 scoops the air flow and directs it onto the pressure responsive surface 148, thereby reducing the wind speed required to move the baffle 138 to the active or closed position illustrated in FIG. 5.

Figure 6:
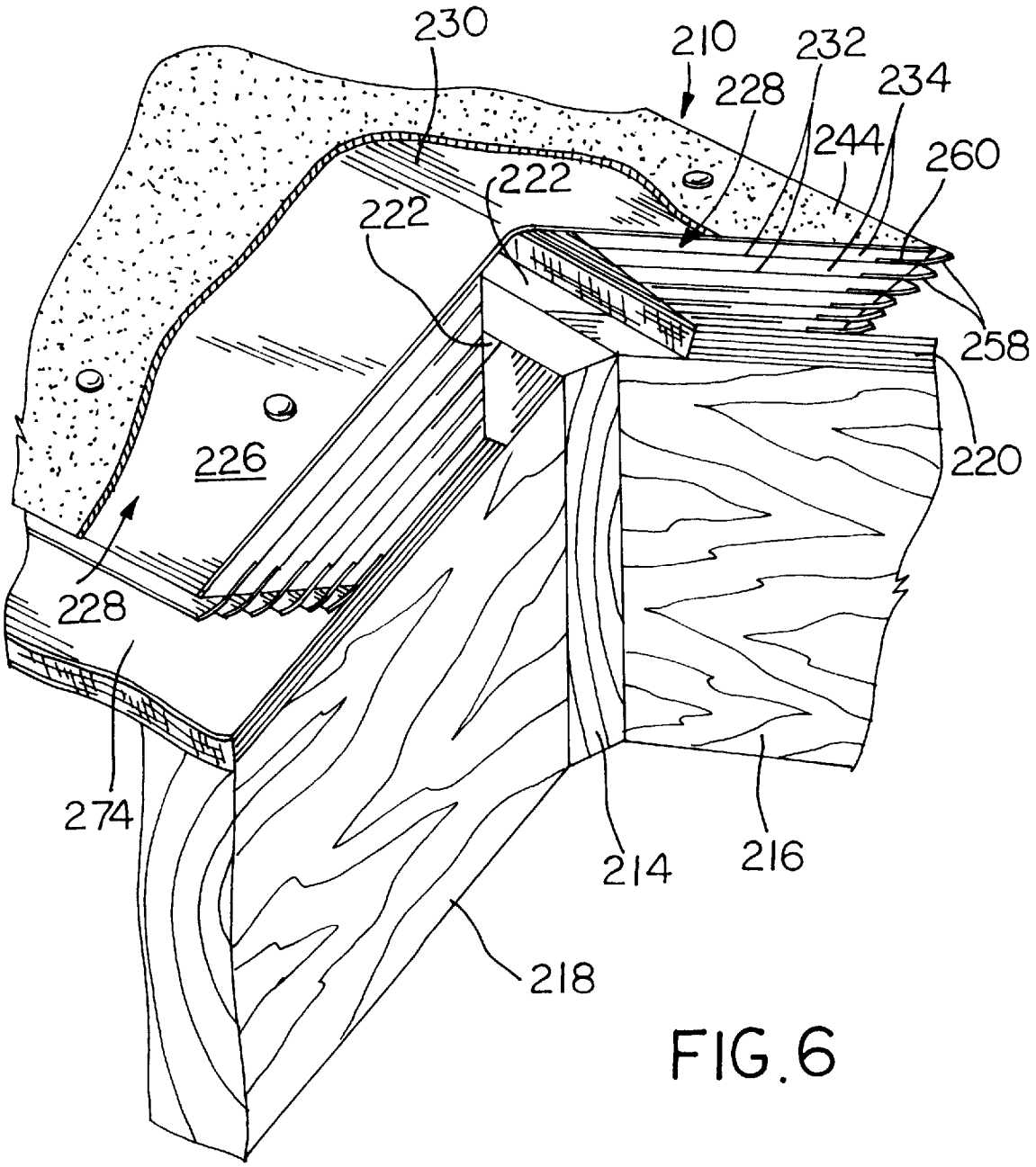
FIG. 6, FIG. 7 and FIG. 8 are views similar to those of FIG. 1, FIG. 2, and FIG. 3 respectively, but showing still another embodiment of the present invention.
Figure 7:
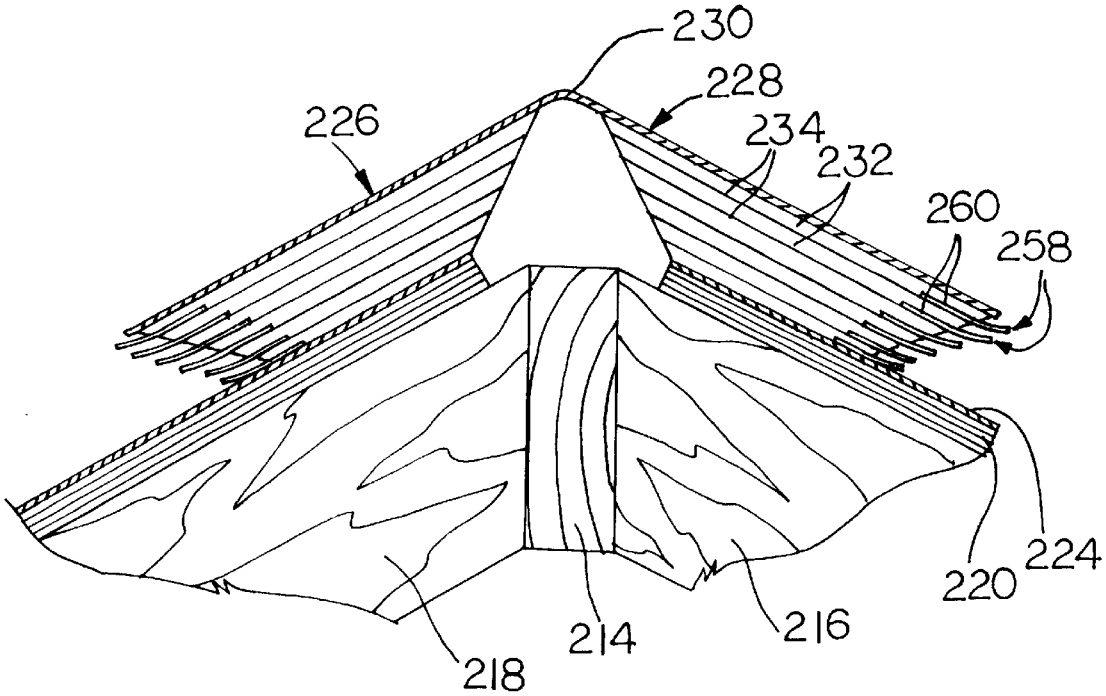
Figure 8:
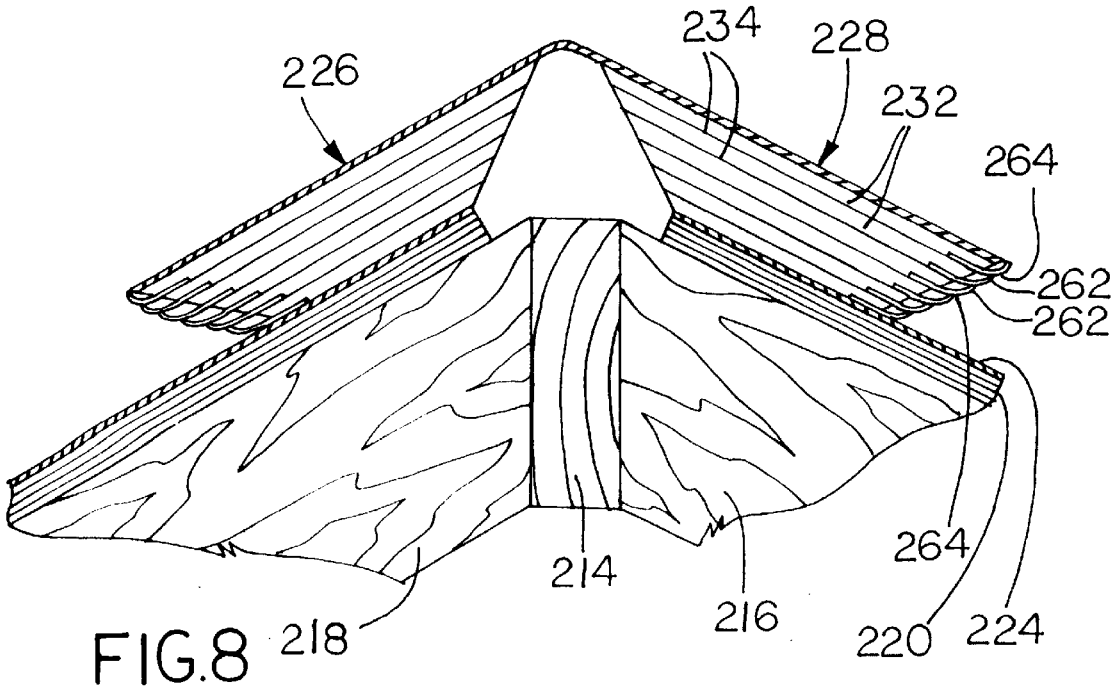

Referring now to the embodiment of FIGS. 6–8, elements the same or substantially the same as those in the embodiment of FIGS. 1–3 retain the same reference numeral but are increased by 200. In the embodiment of FIG. 6, the deflectable baffle 38 of FIGS. 1–3 is replaced by "mini baffles" 258, one mini baffle 258 for each ply 234 of the vent parts 226, 228. The mini baffles 258 each have a retaining portion 260, which is held between adjacent plies 234 and is sealingly secured to each of them. Mini baffles 258 may be made out of a flexible plastic or silicone based material, and are sufficiently long that, as clearly illustrated in FIG. 8, the tip 262 of each baffle (except, of course, the uppermost baffle) engages the lower side 264 of an adjacent baffle to provide a "feathering" effect that completely closes off the passages 232 when the baffles 258 are moved to the active or closed position illustrated in FIG. 8.

Figure 10:
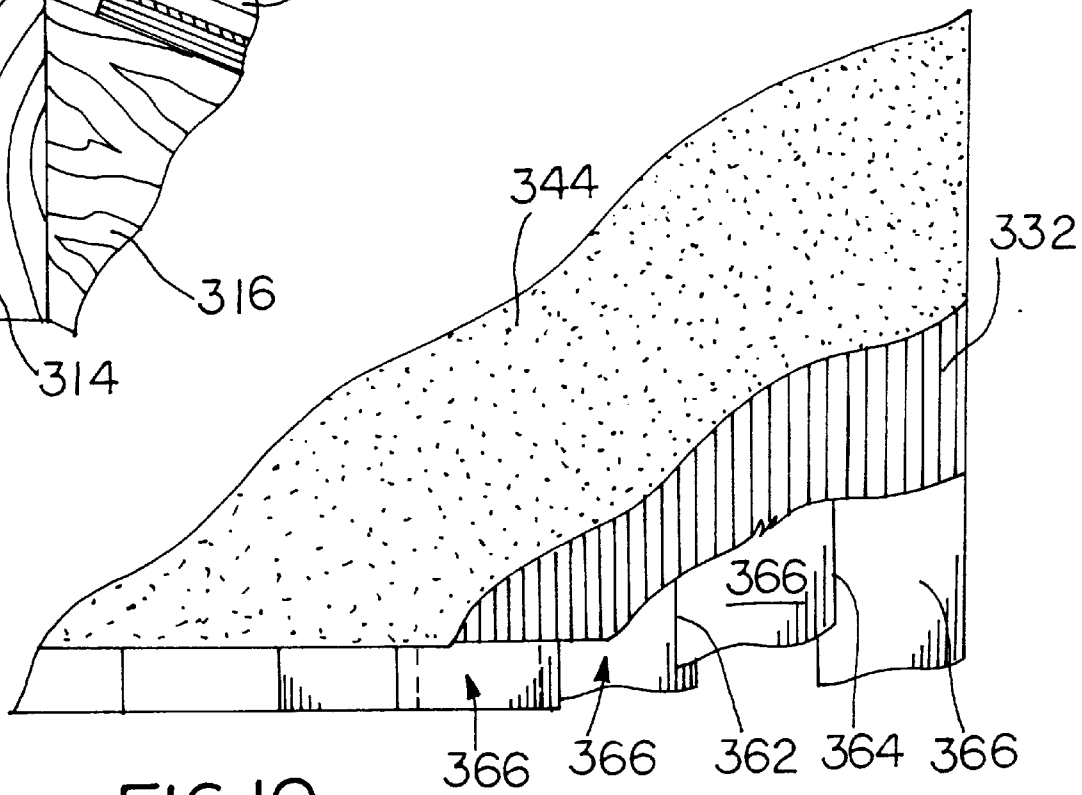
FIG. 10 is a fragmentary top plan view of the device illustrated in FIG. 9.
Figure 9:
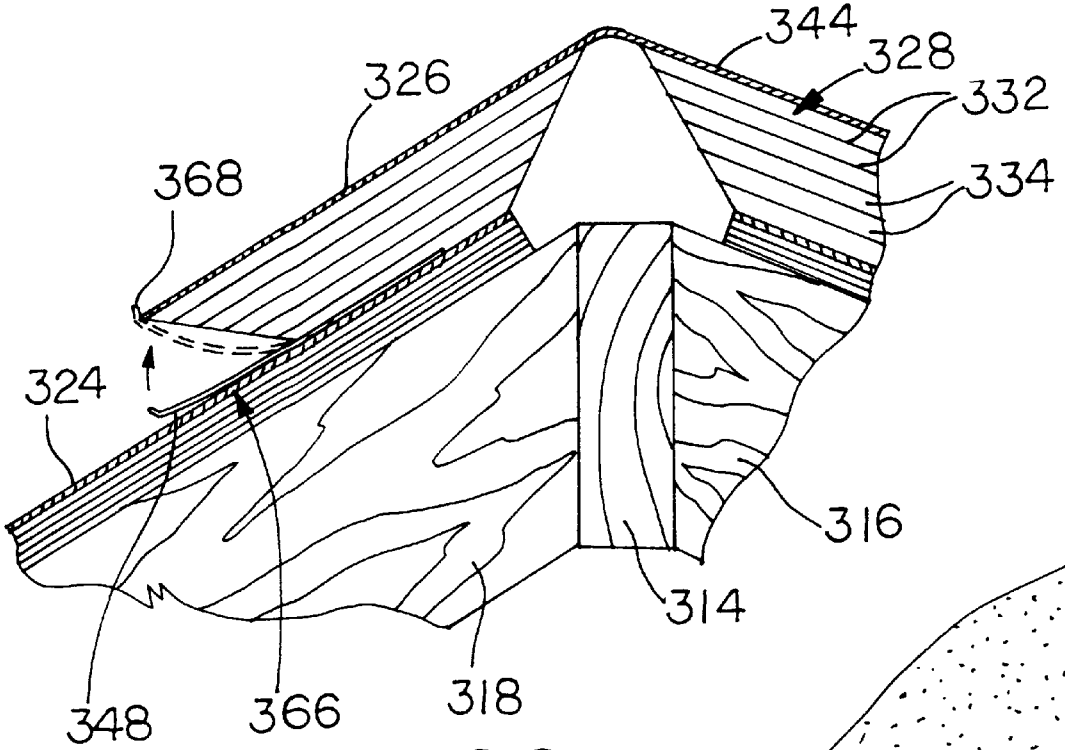
FIG. 9 is a view similar to FIG. 2, but illustrating still another embodiment of the present invention.

Referring now to the embodiment of FIGS. 9 and 10, elements the same or substantially the same as those of the embodiment of FIGS. 1–3 retain the same reference numeral but increased by 300. Referring to FIGS. 9 and 10, the opposite side edges 362, 364 of each baffle 366 overlie a portion of the upper or lower surface of an adjacent one of the baffles 366, so that each of the baffles 366 has side edges which "lap over lap" on adjacent baffles, instead of one of the side edges lying on top of one adjacent baffles and the other side edge lying below another adjacent baffle. In this latter case, the baffles may sometimes wedge together, thereby preventing proper operation. However, with both side edges of each baffle lying against the same (upper or lower) surface of adjacent baffles, wedging is prevented. Each of the baffles 366 is provided with a lip 368 so that ambient wind can more easily scoop up the baffle and reach the pressure responsive surface 348.

Referring now to the embodiment of FIGS. 11–13, elements the same or substantially the same as those in the embodiment of FIGS. 1–3 retain the same reference numeral, but increased by 400. Referring to FIGS. 11–13 vent parts 466, 468 of the ventilating device 410 include a sheet 470 of sheet metal or plastic material perforated as indicated at 472. Each sheet 470 is folded as indicated at 474 to define compartments 476, 478. Compartment 476 has a cross-sectional shape that is roughly triangular, and compartment 478 has a cross-sectional shape that is roughly that of a truncated triangle. The side 480 of compartment 478 which faces away from the opening 422 is slightly curved as indicated in the drawings. A cap plate 482 closes the upper surface of the compartments 472, 480, and shingles 444 are applied thereto. The shingles 444, cap plate 482, and folded sheet metal or plastic 470 are all nailed to the underlayment 420 by roofing nails 484.

A longitudinally extending baffle 486 is confined by the walls of the compartment 478, but is otherwise unattached thereto. As illustrated in FIGS. 11–13, the baffle 486 has a curved cross-section 488 terminating in an upwardly projecting lip 490. The lip 490 catches and directs the airflow, and the curved surface 488 of the baffle 486 acts as an airfoil creating a pressure differential across the baffle to move the baffle from the inactive or open position illustrated in FIG. 12 to the active or closed position illustrated in FIG. 13. The curved wall 480 permits the baffle 486 to move without interference by the walls of the compartment 478. The curved cross-section is not strictly necessary, and flat baffles, or flat baffles with a lip may also be used, but will deflect to the active or closed position at different wind speeds. As illustrated in FIG. 12, when the baffle 486 is in the inactive or lowered position, heat may vent from the attic or upper floor of the structure enclosed by the roof 412, as most clearly indicated in FIG. 12. However, when wind speed increases such that the pressure of air acting against the lip 490 and surface 488 rotates the baffle 486 into the active or closed position illustrated in FIG. 13, wind driven moisture, such as snow or rain, is restricted from entering the attic or upper floor of the structure through the opening 422. Although FIG. 13 illustrates the baffles 48 on both the vent parts 466 and 468 as being in the active or closed position, it will be recognized that under normal circumstances with the prevailing wind from a single direction, only one of the baffles 486 will be closed at any one time, thus maintaining venting even during a storm in which one of the baffles restricts entry of wind driven moisture such as rain and snow. When the wind subsides, the force of gravity acting on the baffle 486 will automatically return it to its inactive or open position illustrated in FIG. 12.

Referring now to the embodiment of FIGS. 14–16, elements the same or substantially the same as those in the embodiment of FIGS. 1–3 retain the same reference character, but increased by 500. Referring to FIGS. 14–16, ridge member 514 is elongated such that it extends above the inclined rafters 516, 518, a pair of frames 556, 558 are secured to the underlayment 520 through the shingles 524. The frames 556, 558 extend upwardly such that the vent openings 522 which extends longitudinally along the ridge member 514 on both sides thereof are enclosed respectively by the frames 556, 558 and a cap roof 560 slopes upwardly from each of the frames 556, 558 to where it is joined to the ridge member 514.

A cover plate 562 is mounted in each one of the frames 556, 568 and is provided with openings defined by upwardly facing louvers 564. The opposite ends of a sliding cover plate 566 are slidably mounted in grooves (not shown) on the ends of each frame 556, 558, and the widths of the cover plates 566 terminate as indicated at 568 so that the cover plates 566 are not as wide as cover cover plates 562 and thus are able to slide in a substantially vertical direction along the cover plate 562 between limits defined by the engagement of edge 568 with the upper edge of the frame and the engagement of lower end of each sliding cover plate 566 with the lower end of its corresponding frame. Each of the sliding cover plates 566 include openings defined by downwardly facing louvers 570. Referring to FIG. 16, the force of gravity at low wind conditions maintains the cover plate 566 downwardly such that the lower edge of plate 566 rests against the lower edge of the corresponding frame 556, 558. In this position, the openings defined by louvers 570 register with the openings defined by louvers 564, thereby providing a vent path from the vent opening 522 to ambient atmosphere. At high wind conditions, the wind scoops into the louvers 570 on the sliding plate 566, which is urged upwardly viewing FIG. 15, into the position illustrated in FIG. 16 in which the upper edge 568 of each of the cover plates 566 rests against the upper edge of the corresponding frame 556 to 558. In this condition, the openings defined by louvers 572 are out of registry with the openings defined by louvers 564, thereby shutting off communication through the louvers to restrict wind driven rain or snow from gaining access to the vent opening 522. The cover plates 562, 566 are both illustrated in FIG. 16 as being disposed in positions shutting off venting. However, as discussed above, under normal wind conditions a prevailing wind acts against only one of the sliding cover plates 566. Accordingly, only the sliding cover plate actuated by the wind will close and the other sliding cover plate will remain open to maintain some venting even under such high wind conditions.

The invention is applied to a tile roof in all of the embodiments disclosed in FIGS. 17–25. Referring now the embodiment of FIGS. 17–19, elements the same or substantially the same as those in the preferred embodiment retain the same reference character, but increased by 600. Referring to FIGS. 17–19, roofing tiles 656 are laid directly upon underlayment 620. The ridge member 614 extends above the level of the inclined rafter 616, 618, and a cap tile 658 is secured to the upper edge of ridge member 614 by fasteners 660. Venting material 662, 664 is secured to opposite sides of the ridge member 614. The venting material 662, 664 is similar to the venting material comprising the vent parts 26, 28 of the embodiment of FIGS. 1–3 and is as more fully described in the aforementioned U.S. Pat. No. 3,949,657. The venting material 662, 664 comprises courses or plies 632 of a corrugated venting material, which defines passages 634 communicating the vent opening 622 with ambient atmosphere through the passages 634 and the opening defined between the cap tile 658 and the roofing tiles 656. Fixed supports 666, 668 are secured to the underlayment 620 and to the ridge member 614 by fasteners driven through the fixed support 666, 668 and the vent material 662, 664 to hold both in place. The supports 666, 668 are grooved as at 670, 672 to define a hinge between the fixed supports 666, 668 and movable members 674, 676 attached thereto. Of course, the movable members 674, 676 may be entirely separate from the support 666, 668 and connected thereto by a separate hinge. Moveable members 674, 676 terminate in transversely extending portions 678, 680. The portions 678, 680 taper down to a very thin, flexible sealing edge 682, 684, for sealingly engaging the ridge member 614 when the movable members 670, 672 are moved into the active or sealing position as illustrated in FIG. 18. Curved legs 686, 688 extend from movable member 674, 676 and, when the movable members are in their open or inactive position illustrated in FIGS. 17 and 18, legs 686, 688 engage the fixed supports 666 and 668 to limit deflection of the movable members 674, 676 to that shown in the drawings.

As discussed above, the movable members 674, 676 are in the open position illustrated in FIGS. 17 and 18. Heat is vented from the attic or upper story of the structure upon which the roof is used through the passages 634 of the venting material 662, 664 and around the movable member 674, 676 into ambient atmosphere through gaps between the cap tile 658 and the roofing tile 656. However, when ambient wind speed exceeds a predetermined minimum, one or the other of the movable member 674, 676 are moved to the active or closed position illustrated in FIG. 19 wherein one or both of the tips 682, 684 sealingly engage with the ridge member 614, the thinness and resiliency of the tips 682, 684 assuring an effective seal. Accordingly, wind driven moisture is prevented from entering the passages 634. Of course, as discussed above, the ambient wind is generally from a direction wherein only one of the movable members 674, 676 are closed at any one time; accordingly, even under such adverse wind conditions, some venting is still permitted through the vent material where the other movable member 674 or 676 has not closed off the vent passage 634.

Referring now to the embodiment of FIGS. 20–22, elements the same or substantially the same as those in the embodiment of FIGS. 17–19 retain the same reference character, but are appended by the numeral 7 instead of by the numeral 6. In the embodiment of FIGS. 20–22, the movable arms 674, 676 are replaced by flexible loops 784, 786 of a flexible, elastic material which are mounted on divergent arms 788, 790 which extend from the extend from the corresponding support 766 or 768 and run parallel to, but extend substantially beyond, the arms 788, 790. The legs 791, 793 serve as a rest for the loops of material 784, 786 to thereby limit deflection of these loops when they move into the inactive or open position during low wind conditions. The longitudinally extending loops of material 784, 786 inherently return to their open or inactive positions illustrated in FIG. 21 due to the force of gravity acting on the outwardly deflecting portions 788, 790.

Referring now to the embodiments of FIGS. 23–25, elements the same or substantially the same as those in the embodiment of FIGS. 17–19 retain the same reference numeral, but are appended by the numeral 8 instead of by the numeral 6. In the embodiment of FIGS. 23–25, the ridge member 814 terminates at the same level as the inclined rafters 816, 818. The cap tile 868 is attached to a sheet metal or plastic member generally indicated by the numeral 885 which is defined by a pair of spaced, substantially parallel side edges 886 and 888, a top edge 890 which connects the side edges 886 and 888, and a pair of diverging legs 892, 894, which project outwardly from the ends of the edges 886, 888 opposite the ends connected by the edge 890. The outwardly diverging portions 892, 894 are secured to the sheathing or underlayment 820 by appropriate fasteners such as nails (not shown) which also extend rough supports 866, 868 which carry the arms 874, 876. Each of side edges 886, 888 are provided with louvers 896 to provided a venting path from the vent opening 822 to atmosphere when the s 874, 876 are in their open or inactive position illustrated FIGS. 23 and 24. In operation, the embodiment of FIGS. 23–25 operates in the same way as does the embodiments of FIGS. 17–19, with the edges 882, 884 of the transversely extending portions 878, 880 of arms 874, 876 engaging the side edges 886, 888 to thereby restrain communication through the louvers 896. The arms 876 are returned to their open or inactive positions illustrated in FIGS. 23 and 24 as described above with respect the embodiments of FIGS. 17–19.

I claim:

1. A ventilating device for a roof having a longitudinally extending ridge member supported by transversely spaced inclined rafters, a vent opening in said roof extending longitudinally along said ridge board, said ventilating device including a cover for said vent opening, said cover extending over said ridge board and including a pair of longitudinally extending vent parts extending along said vent opening substantially parallel to said ridge member, each of said vent parts being mounted on said roof on opposite sides of said ridge member, said vent parts defining a plurality of vent passages for communicating the vent opening to ambient atmosphere, and an elongated, longitudinally extending moveable member extending along said vent parts substantially parallel to said ridge board and movable from an inactive position permitting communication through said passages to an active position closing said passages to prevent entry of wind driven moisture into said passages, said member including a pressure responsive surface responsive to atmospheric wind to move said member from said inactive position opening said passages to said active position closing said passages in response to wind in excess of predetermined ambient wind speed, said member restoring itself to the inactive position when the ambient wind speed drops below the predetermined ambient wind speed, said member being oriented with respect to said roof such that the force of gravity urges said member to the inactive position.

2. Ventilating device as claimed in claim 1, wherein said member is made of a resilient material, the resiliency of said material yieldably urging said member to the inactive position, the pressure on said pressure responsive surface urging said member in opposition to the resiliency thereof toward the active position.

3. Ventilating device as claimed in claim 1, wherein said roof has oppositely sloping sides converging to define the ridge of said roof, said vent opening extending longitudinally along the ridge of said roof, said cover extending along the ridge of said roof to cover said vent opening and having a longitudinally extending edge defined by the ends of said passages, said movable member being a deflectable baffle secured to said cover and having a closing portion extending beyond the ends of the passages, said closing portion closing said ends when the baffle is in the active position, said pressure responsive surface being defined on said closing portion.

4. Ventilating device as claimed in claim 3, wherein said roof includes a roofing surface to which said cover is secured, said baffle including a retaining portion held between said surface and said cover to secure said baffle to said cover and to said roof, said closing portion of the baffle extending from said section.

5. Ventilating device as claimed in claim 3, wherein said closing portion is divided into longitudinally extending sections by transversely extending slits in said closing portion to permit relative movement of said longitudinally extending sections with respect to each other.

6. Ventilating device as claimed in claim 3, wherein said closing portion terminates in a lip projecting from said closing portion.

7. Ventilating device as claimed in claim 3, wherein said cover includes multiple plies of a corrugated material defining said passages.

8. Ventilating device as claimed in claim 3, wherein said cover includes multiple plies of material defining said passages, there being deflectable baffles for each of said plies for closing the passages defined in each corresponding ply.

9. Ventilating device as claimed in claim 8, wherein the length of the deflectable baffle for each of said plies is sufficiently long that each deflectable baffle engages the deflectable baffle of an adjacent ply when the deflectable baffles are in the active position.

10. Ventilating device as claimed in claim 3, wherein said closing portion is divided into longitudinally extending sections, each of said longitudinally extending sections having transversely extending edges, at least one of the transversely extending edges of each of the longitudinally extending sections being covered by an adjacent longitudinally extending section.

11. Ventilating device as claimed in claim 1, wherein said cover includes a longitudinally extending cover plate extending along said roof, said cover plate having louvers permitting communication through said plate and defining in part said passages, said movable member being a movable plate slidable with respect to the cover plate between said inactive position permitting communication through the louvers on the cover plate to said active position closing communication through said louvers on the cover plate.

12. Ventilating device as claimed in claim 11, wherein said movable plate slides along said cover plate as the movable plate moves between the active and inactive positions, said movable plate having louvers defining in part said passages and registering with the louvers in the cover plate when the movable plate is in the inactive position to permit communication through said plates, said louvers in the movable plate moving out of registry with the louvers in the cover plate when the movable plate moves to the active position.

13. Ventilating device as claimed in claim 12, wherein the louvers in the cover plate face opposite from the louvers in the movable plate.

14. Ventilating device as claimed in claim 1, wherein said roof includes a longitudinally extending ridge member, said vent opening extending longitudinally along said ridge member, said movable member including an immovable support mounted on said roof adjacent said opening and a movable portion movable mounted on said support and moving from said inactive position in which the movable portion is disposed away from said ridge member to said active position in which the movable portion engages said ridge member to restrain communication through said opening.

15. Ventilating device as claimed in claim 14, wherein said passages are defined by plies of corrugated roofing material fastened between said support and said ridge member.

16. Ventilating device as claimed in claim 14, wherein said movable portion is an arm pivotally mounted on said support.

17. Ventilating device as claimed in claim 14, wherein said movable portion is flexible material secured to said support.

18. Ventilating device as claimed in claim 17, wherein said material is a waterproof fabric.

19. Ventilating device as claimed in claim 14, wherein said passages are defined by plies of corrugated roofing material, said support and said roofing material being fastened to said ridge member by fasteners extending through said support and said roofing material and into said ridge member.

20. Ventilating device as claimed in claim 14, wherein said ridge member is made of sheet metal or plastic, said ridge member defining said cover, said passages being defined by louvers in said ridge member.

21. A ventilating device for a roof having a vent opening in said roof, said ventilating device including a cover for said vent opening, said cover defining a plurality of vent passages for communicating the vent opening to ambient atmosphere, and a movable member movable from an inactive position permitting communication through said passages to an active position closing said passages to prevent entry of wind driven moisture into said passages, said member including a pressure responsive surface responsive to atmospheric wind to move said member from said inactive position opening said passages to said active position closing said passages in response to wind in excess of a predetermined ambient wind speed, said member restoring itself to the inactive position when the ambient wind speed drops below the predetermined ambient wind speed, said cover including a sheet of perforated material folded to define a lower engagement area for engagement by said roof, an upper engagement area, a cover plate closing said upper engagement area, and a pair of longitudinally extending perforated side walls, said side walls cooperating with said roof and said cover plate to define longitudinally extending compartments between said roof and said cover plate, said passages being defined in part by the perforations in said side walls, said movable member being a deflectable baffle within one of said compartments movable to said active position in which the baffle engages one of said side walls, said baffle being an elongated strip of imperforate material restrained by the walls of said compartment, said baffle being unattached to the walls of the compartment.

22. Ventilating device as claimed in claim 21, wherein said baffle has a concave cross section.

23. Ventilating device as claimed in claim 21, wherein said baffle is defined by a pair of longitudinally extending edges, one of said edges being defined on a lip projecting from said strip.

24. Ventilating device for a roof having a vent opening in said roof, a cover for said vent opening including a sheet of perforated material folded to define a lower engagement area for engagement by said roof, an upper engagement area, a cap plate closing said upper engagement area, and longitudinally extending perforated side walls, said side walls cooperating with said roof and said cover plate to define longitudinally extending compartments between said roof and said cover plate, and a deflectable baffle within one of said compartments movable between an active position in which the baffle engages one of said side walls to close off the perforations in said one side wall to an inactive position permitting communication through the perforation in said one side wall, said baffle being unattached to the walls of the compartment.

25. Ventilating device as claimed in claim 24, wherein said baffle is a concave cross-section.

26. Ventilating device as claimed in claim 24, wherein said baffle is defined by a pair of longitudinally extending edges, one of said edges being defined by a lip projecting from said strip.

* * * * *